US007712336B2

(12) United States Patent
O'Connor et al.

(10) Patent No.: US 7,712,336 B2
(45) Date of Patent: May 11, 2010

(54) SUBASSEMBLY FOR INDUSTRIAL FABRICS

(75) Inventors: Joseph Gerald O'Connor, Hopedale, MA (US); Maurice Paquin, Plainville, MA (US); Dana Burton Eagles, Sherborn, MA (US); Francis L. Davenport, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 548 days.

(21) Appl. No.: 11/700,376

(22) Filed: Jan. 31, 2007

(65) Prior Publication Data

US 2008/0179030 A1 Jul. 31, 2008

(51) Int. Cl.
*D04B 1/22* (2006.01)

(52) U.S. Cl. ..... 66/170; 66/190

(58) Field of Classification Search ..... 66/170, 66/169 R, 190, 196; 139/383 AA, 383 A
See application file for complete search history.

(56) References Cited

U.S. PATENT DOCUMENTS

| | | | | | |
|---|---|---|---|---|---|
| 4,427,107 | A | | 1/1984 | Roberts et al. | |
| 4,761,329 | A | | 8/1988 | Halker et al. | |
| 4,856,562 | A | * | 8/1989 | Dufour | 139/383 A |
| 4,883,097 | A | * | 11/1989 | Dufour | 139/439 |
| 4,948,658 | A | * | 8/1990 | Halker | 442/314 |
| 5,049,425 | A | | 9/1991 | Essele | |
| 5,175,037 | A | * | 12/1992 | Merckens et al. | 428/57 |
| 5,204,150 | A | * | 4/1993 | Davenport | 428/58 |
| 5,268,076 | A | | 12/1993 | Best et al. | |
| 5,360,656 | A | * | 11/1994 | Rexfelt et al. | 428/193 |
| 5,713,399 | A | | 2/1998 | Collette et al. | |
| 5,732,749 | A | * | 3/1998 | Fargeout | 139/383 AA |
| 5,785,818 | A | * | 7/1998 | Fekete et al. | 162/358.2 |
| 5,799,709 | A | * | 9/1998 | Shipley | 139/383 AA |
| 5,888,915 | A | * | 3/1999 | Denton et al. | 442/200 |
| 5,945,357 | A | | 8/1999 | Quigley | |
| 6,124,015 | A | * | 9/2000 | Baker et al. | 428/99 |
| 6,162,518 | A | | 12/2000 | Korfer | |
| 6,174,825 | B1 | * | 1/2001 | Dutt | 442/43 |
| 6,182,375 | B1 | * | 2/2001 | Banerjee | 34/398 |
| 6,213,164 | B1 | * | 4/2001 | Ostermayer et al. | 139/383 AA |
| 6,265,048 | B1 | * | 7/2001 | Rydin et al. | 428/121 |
| 6,811,849 | B2 | * | 11/2004 | Best | 428/58 |
| 2004/0026058 | A1 | | 2/2004 | Watanabe et al. | |
| 2004/0157045 | A1 | | 8/2004 | Davenport | |
| 2004/0159362 | A1 | | 8/2004 | Ogiwara | |

* cited by examiner

*Primary Examiner*—Danny Worrell
(74) *Attorney, Agent, or Firm*—Frommer Lawrence & Haug. LLP; Ronald R. Santucci

(57) ABSTRACT

A method of manufacturing an industrial fabric comprising the steps of knitting a first fabric strip portion having two widthwise edges and a width that is narrower than the industrial fabric to the desired length of the industrial fabric, forming the first fabric strip portion into an endless loop by joining the widthwise edges with a CD seam, placing the first fabric strip portion around two rotatably mounted rolls and knitting a second fabric portion to the desired length of the industrial fabric, where knitting of the second fabric portion proceeds along the first edge of the first fabric portion and is a knitted continuation thereof. Alternatively, knitted fabric strips can be joined together in a spiral fashion to create a full width industrial fabric.

18 Claims, 17 Drawing Sheets

SUBASSEMBLY FOR INDUSTRIAL FABRICS

BACKGROUND OF THE INVENTION

1. Field of the Invention

The instant invention relates generally to industrial fabrics. More particularly, the invention relates to a replacement for conventional weaving of substrates and fabrics for endless or seamed industrial fabrics, such as those used in the forming, pressing and dryer sections of a papermaking machine. The invention, however, can also be applied to industrial fabrics used in applications other than papermaking.

2. Background of the Invention

During the papermaking process, a cellulosic fibrous web is formed by depositing a fibrous slurry, that is, an aqueous dispersion of cellulose fibers, onto a moving forming fabric in the forming section of a papermaking machine. A large amount of water is drained from the slurry through the forming fabric, leaving the cellulosic fibrous web on the surface of the forming fabric.

The newly formed cellulosic fibrous web proceeds from the forming section to a press section that includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is sequentially directed in a serpentine path around each in the series of drums by a dryer fabric, which holds the paper sheet closely against the surfaces of the drums. The heated drums reduce the water content of the paper sheet to a desirable level through evaporation.

It should be appreciated that forming, press and dryer fabrics all take the form of endless loops on the papermaking machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The instant invention relates primarily to the press fabrics used in the press section of a papermaking, tissue or through-air drying (TAD) machine, but it may also find application in the forming and dryer sections of a papermaking, tissue or TAD machine, in which the fabrics are generally known as forming fabrics, dryer fabrics, and TAD fabrics as well as in those fabrics used as bases for polymer-coated paper industry process belts, such as, for example, long nip press belts.

Forming fabrics play a critical role during the papermaking process. One of their functions is to form and convey the product being manufactured from the forming section to the press section or next papermaking operation. Dryer fabrics play a critical role as well, transporting the paper product through the dryer section of the papermaking machine.

In addition, the instant invention may be used to construct corrugator belts used to manufacture corrugated paper board and engineered fabrics used in the production of wetlaid and drylaid pulp, in processes related to papermaking such as those using sludge filters and chemiwashers, and in the production of nonwovens produced by hydroentangling (wet process), meltblowing, spunbonding airlaid, or needle punching. Such fabrics and belts include, but are not limited to embossing, conveying, and support fabrics and belts used in processes for producing nonwoven products.

Contemporary fabrics are used in a wide variety of styles designed to meet the requirements of the papermaking machines on which they are installed for the paper grades being manufactured. Generally, they comprise a woven base fabric, which, depending on the application may include a needled batting of fine, nonwoven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the papermaking machine clothing arts.

Woven fabrics take many different forms. For example, they may be woven endless, or flat woven and subsequently rendered into endless form with a seam. Alternatively, they may be produced by a process commonly known as modified endless weaving, wherein the widthwise edges of the base fabric are provided with seaming loops using the machine direction (MD) yarns thereof. In this process, the MD yarns weave continuously back and forth between the widthwise edges of the fabric, at each edge turning back and forming a seaming loop. A base fabric produced in this fashion is placed into endless form during installation on a papermaking machine, and for this reason is referred to as an on-machine-seamable fabric. To place such a fabric into endless form, the two widthwise edges are seamed together by interdigitating the seaming loops at the two ends of the fabric, and by directing a so-called pin, or pintle, through the passage defined by the interdigitated seaming loops in order to lock the two ends of the fabric together.

Further, the woven base fabrics may be laminated by placing one base fabric within the endless loop formed by another, and in the case of press fabrics, by needling a staple fiber batt through both base fabrics to join them to each other. One or both woven base fabrics may be of the on-machine-seamable type.

In addition to woven fabrics, knitted fabrics have been used for paper machine clothing, such as for press fabric substrates that enables advantage to be taken of the inherent characteristics of a knitted fabric. Knitted fabrics are advantageous over woven fabrics for many reasons. In the production of a woven structure, the cost of production increases as the cloth width increases due to the reduction in weaving speed. For example, a loom on which a woven structure is produced can operate at and above 60 weft insertions per minute on cloths of 100 inches wide, whereas for cloths of 380 inches wide, the speed of weft insertions can be as low as 30 insertions per minute. In knitting, however, the production speed is largely independent of width, and production speeds are approximately eight times higher at 60 inches. Since a knitting machine results in a much higher production rate when compared to that of a weaving loom, knitted fabrics have a substantial cost advantage as compared with equivalent woven fabrics For forming fabrics, which are flat woven and require a complex woven seam to create an endless fabric loop, use of knitted fabrics joined together as defined herein eliminate the need for costly seaming. Furthermore, the weave patterns for forming fabrics are limited to those which can be seamed to make the fabric endless. Also, for all fabrics, the flow passage of fluids, whether air, water or a combination thereof, are limited by the size of the yarns and weave patterns incorporated. Knits on the other hand introduce a greater degree of freedom in designing the fluid flow path geometry. Additionally, certain materials such as polyethylene naphthalene (PEN) have been desired as a high modulus yarn material to be used as the MD or load bearing yarns in a forming fabric. PEN, however, is easily abraded during the weaving process. PEN is also brittle and the resulting seam strength is usually low. Incorporating PEN as a MD member in a warp knit structure will allow use of this material and similar materials by overcoming the previously discussed inherent shortcomings of such materials.

In addition, in many cases in which a conventional woven structure is used, knuckles are formed on the yarn crossover points. These knuckles are susceptible to abrasive wear and can result in marking of the product being manufactured, and in the case of papermaking dryer fabrics and certain fabrics for the production of nonwoven products, can cause an excessive amount of entrained boundary layer air resulting in distortion of the product being produced. A knitted structure, however, can be designed to have a smoother sheet contact surface using the same material component yarns, while also having a higher flexural resistance and hence a longer service life.

In any event, fabrics and substrates can be in the form of endless loops, or can be seamable into such forms, having a specific length, measured longitudinally therearound, and a specific width, measured transversely thereacross. Because papermaking machine configurations vary widely, papermaking machine clothing manufacturers are required to produce forming, press and dryer fabrics, as well as other papermaking machine clothing, to the dimensions required to fit particular positions in the papermaking machines of their customers. Needless to say, this requirement makes it difficult to streamline the manufacturing process, as each fabric must typically be made to order.

Fabrics in modern papermaking machines may have a width of from 5 to over 33 feet, a length of from 40 to over 400 feet and weigh from approximately 100 to over 3,000 pounds. As would be expected, these fabrics wear out and require replacement. Replacement of fabrics often involves taking the machine out of service, removing the worn fabric, setting up to install a fabric and installing the new fabric.

In response to this need to produce fabrics in a variety of lengths and widths more quickly and more efficiently, subassembly of narrow width woven or nonwoven substrates into full width fabrics has become an established method of manufacturing for press fabrics. There are benefits in both the performance of the fabric due to its structure and in the efficiencies of manufacturing the fabric. A key requirement for subassembly of narrow width material strips into full size fabrics is to devise a joining method along the length of the substrate strips. Numerous methods have been employed including sewing, ultrasonic bonding and thermal bonding. In all cases, however, the resulting bond has two potential limitations: (1) the bond strength, measured as cross-machine direction (CD) breaking strength, is usually lower than that of the body of the strip itself; and (2) the joined area does not have exactly the same uniformity as the body of the strip, especially with respect to fluid flow, whether air or water, which results in the potential for objectionable marking of the paper product.

In press fabrics, a needled fiber batt structure compensates to a degree for these limitations. The key bond strength requirement in the subassembly of the press fabric is to enable handling of the substrate through the needling process. The MD strength in the final fabric comes from the yarns/monofilaments of the substrate, while the CD strength comes from the bond and the needled fiber batt. The batt also helps to mask the structural discontinuity at the MD oriented seam points in the subassembled narrow width strips, which would otherwise cause marking of or non-uniform water removal from the paper product being manufactured.

In response to the need to produce fabrics in a variety of lengths and widths more quickly and efficiently, fabrics and substrates have been produced using a spiral winding technique disclosed in commonly assigned U.S. Pat. No. 5,360,656 to Rexfelt et al., the contents of which are incorporated herein by reference.

U.S. Pat. No. 5,360,656 discloses a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine direction. Lengthwise threads of the spirally wound strip make an angle with the longitudinal direction of the press fabric. The strip of woven fabric may be flat-woven on a loom that is narrower than those typically used in the production of papermaking machine clothing. A loom as narrow as 20 inches (0.5 meters) could be used to produce a woven fabric strip, but, for reasons of practicality, a conventional textile loom having a width of from 40 to 60 inches (1.0 to 1.5 meters) may be preferred.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the spirally continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

In any case, a base fabric, taking the form of an endless loop and having an inner surface, a longitudinal (machine) direction and a transverse (cross-machine) direction, is the result. The lateral edges of the base fabric are then trimmed to render them parallel to its longitudinal (machine) direction. The angle between the machine direction of the base fabric and the spirally continuous seam may be relatively small, that is, typically less than 10-degrees. By the same token, the lengthwise (warp) yarns of the fabric strip make the same relatively small angle with the longitudinal (machine) direction of the base fabric. Similarly, the crosswise (filling) yarns of the fabric strip, being substantially perpendicular to the lengthwise (warp) yarns, make the same relatively small angle with the transverse (cross-machine) direction of the base fabric.

Commonly assigned U.S. patent application Ser. No. 10/364,145 filed Feb. 11, 2003 entitled "Unique Fabric Structure for Industrial Fabrics," the contents of which are incorporated herein by reference, discloses an industrial process fabric that is endless or made endless with a seam in a machine direction. The industrial process fabric comprises at least one layer of spiral turns formed by a spirally-wound strip of material, where the strip of material has a width that is narrower than the width of the industrial process fabric. The material strip can either be woven, nonwoven, knitted or an array of MD or CD yarns. Each spiral turn abuts against or overlaps with those adjacent thereto and are attached to each other using a bonding technique such as ultrasonic bonding, adhesive bonding, bonding through a low melt material and bonding through the use of bondable yarns. In addition, the spirally-wound material strips may be joined by sewing the longitudinal edges to one another. When an industrial process fabric comprising at least two layers is required, with each layer having a plurality of spiral turns formed by the spirally-wound strip of material, the layers are joined to each other using one of the previously described bonding techniques.

U.S. Pat. No. 6,162,518 discloses a length of textile that is used as a papermaking machine cover. To form the machine cover, a textile strip is drawn from a transversely moving supply roll onto two spaced rollers. Since the supply roll is moving in a direction transverse to the rollers, the textile strip is helically wound onto the rollers. The helical winding results in a plurality of textile strips having longitudinal edges that abut up against each adjacent edge. The helical winding of the textile strip continues until a desired width fabric is achieved.

Each textile strip consists of transverse threads (structural threads), which when taken together form a transverse thread bundle, and longitudinal threads (structural threads), which when taken together form a longitudinal thread bunch. The transverse and longitudinal threads (structural threads) are joined to one another at their intersection points, for example by bonding, cementing or the like. The structural threads are preferably part of a fabric, knit, thread bunch or an insert within a film or the like. To join the adjacent textile strips, the transverse threads from each edge of the adjacent textile strips are interdigitated with one another. Once interdigitated, a connecting thread, parallel to the longitudinal direction, is then placed over the interdigitated transverse threads and bonded to the transverse threads using an ultrasonic bonding means. Adjacent textile strips are joined in a like manner until a desired width paper machine cover is achieved.

U.S. Pat. No. 5,268,076 discloses a spirally-wound papermaking machine belt especially for use as a press belt. The belt comprises a plurality of fiber-belt strips and support belt strips. The fiber-belt strips consist of a fiber web which may evince different fiber orientations, finenesses and fiber densities, whereas the support belt strips may evince different structures such as woven, knit, spun fiber web, foil and or strips of composite sheets of nonwoven filaments. In addition to supply rolls that include the fiber-belt strips and the support belt strips, the belt manufacturing device comprises a needling machine and two advance rollers rotating on horizontal shafts, positioned horizontally apart.

At the beginning of the manufacturing process, a first strip of belt-material ("forming strip") is pulled onto the two advance rollers. This forming strip acts as support or a forming platform for the belt during the belt construction process. Mounted thereupon are the individual fiber-belt strips and support belt strips from the supply rolls. Once the fiber-belt strips and support belt strips are mounted, the two advance rollers and the forming strip are displaced in the direction of advance whereby the fiber-belt and support belt strips are withdrawn from the supply rolls onto the forming strip in a spirally wound manner. Simultaneously with the addition of the fiber-belt and support belt strips to the forming strip, the needling machine is actuated so that the individual belt strips are needled together such that the fibers of the fiber-belt strips penetrate the support belt strips.

The process continues until the belt has attained its desired width. Once the finished belt is removed from the advance rollers, the forming strip that was used to support the belt during the forming process is removed, resulting in a belt that is either finished or one in which further processing may be performed. The support belt strips into which fibers from the fiber-belt strips are needled may have various configurations, such as having longitudinal edges that partly overlap or longitudinal edges that do not overlap and instead abut up against one another. In all configurations, however, the fiber-belt strips and the support belt strips are attached to one another by needling.

Commonly assigned U.S. Pat. No. 5,713,399, the contents of which are incorporated herein by reference, shows an approach to forming and closing the spirally continuous seam in a fabric of this type. According to the disclosed method, the fabric strip has a lateral fringe along at least one lateral edge thereof, the lateral fringe being unbound ends of its crosswise yarns extending beyond the lateral edge. During the spiral winding of the fringed strip, the lateral fringe of a turn overlies or underlies an adjacent turn of the strip, the lateral edges of the adjacent turns abutting against one another. The spirally continuous seam so obtained is closed by ultrasonically welding or bonding the overlying or underlying lateral fringe to the fabric strip in an adjacent turn.

As disclosed in U.S. Pat. No. 6,124,015, a multi-layer industrial fabric is assembled from at least one segment comprising at least one woven or nonwoven ply, in which the joints utilize jointing yarns or structures. The jointing structures, which may be continuous or discontinuous, engage with and interlock with each other to provide a secure mating engagement at selected locations on the segment(s), making up the fabric. The planar surfaces forming the joints are in the plane of the finished fabric and are thus not edge-to-edge joints. The fabric structure is assembled by interlocking together as many segments as are needed, to provide the required finished industrial fabric. For some applications it is desirable to make the interlocked joint between the jointing structures more secure. Examples of how to make the interlocked joint more secure include adhesives, chemically reactive systems such as polyurethane, or in the alternative, an inert layer of nonwoven material may be inserted between the plies, such as a thin layer of fibrous batt. A web of hot melt adhesive may also be used. This process, however, still results in a joint between the lateral edges of the segments that were joined together, which as aforementioned is a weak point of the fabric.

In addition to the previously discussed joining methods used to join adjacent fabric strips along the length of a substrate, is a butt seam that can be found in the aforementioned U.S. Pat. No. 5,360,656. This seam is between adjacent strips of fabric and includes stitching. The seams, however, are not load bearing and are merely there to hold the strips together so that the "base" structures formed by these joined together strips can be handled through subsequent manufacturing processes such as needling.

In any structure that comprises spirally wound strips of material, the connecting seam between two adjacent strips is a critical part of the fabric since uniform paper quality, low marking and excellent runnability of the fabric require a seam which is as similar as possible to the rest of the fabric with respect to properties such as thickness, structure, strength, permeability, etc. It is therefore important that the seam connecting region between adjoining spirally wound strips of material of any workable fabric in operation, have the same permeability to water and air as the rest of the fabric, thereby preventing marking by the seam region on the product being manufactured. Despite the considerable technical obstacles presented by these requirements, it is highly desirable to develop spirally wound fabrics because of the types of structures that can be incorporated, such as knits.

As previously discussed, the connecting seam region strength in press fabrics formed by spirally winding strips of material may be increased with the addition of a needled fiber batt material; this, however, is not an option with forming and dryer fabrics, or any other "fabric" that does not employ a layer of needled batt fibers. In forming and dryer fabrics, the structure has no batting to mask the discontinuities which may result from joining narrow width substrates to make a full width product and the bond strengths of current joining methods would not be sufficient in and of themselves for the fabrics to maintain their structural integrity and run on current machines.

Therefore, a need exists to provide an alternative to current methods used to create full size industrial fabrics and substrates base structures for fabrics, where the fabrics and substrates are created in portions from narrow width knitted structures, resulting in an assembled fabric having a strong, virtually undetectable connecting means between adjacent spirally wound knitted strips of material.

SUMMARY OF THE INVENTION

It is therefore a principal object of the invention to provide full length, full width fabrics and substrates for use as, or in the construction of, industrial fabrics.

It is a further object of the invention to provide fabrics that are created in portions from knitted strips of fabric having a width less than the width of the finally assembled fabrics.

Yet another object of the invention is to provide fabrics constructed from knitted fabric strip portions that are joined to one another using knitting techniques.

A still further object of the invention is to provide knitted fabrics and substrates having increased connection strength between the adjacent longitudinal edges of the joined fabric strip portions.

A further object of the invention is to provide knitted fabrics having a uniform profile of key fabric properties such as mass, caliper, fluid permeability, etc., across the width of the finally assembled fabrics that eliminates or reduces sheet marking and non-uniform water removal in the product being produced.

These and other objects and advantages are provided by the instant invention. In this regard, the instant invention is directed to full width industrial fabrics and a method of manufacturing such fabrics. Using two rotatably mounted rolls that are parallel to each other, similar to that taught in aforementioned U.S. Pat. No. 5,360,656, the method includes knitting a first fabric strip portion to the desired length of the industrial fabric, where the width of the first fabric strip portion is narrower than the width of the final industrial fabric. Upon completion of the first fabric strip portion, the fabric strip portion is made into an endless loop by joining the two widthwise edges of the strip together using a CD knitted seam. Once made endless, the first fabric strip portion is wound or placed onto two parallel rolls such that the lengthwise edges of the fabric strip portion are parallel with the machine direction of the fabric or perpendicular to the central axes of the two parallel rolls, and knitted loops along a lengthwise edge of the first fabric strip portion are located.

Once the knitted loops are located, knitting of a second fabric strip portion having a width narrower than the completed industrial fabric proceeds along the lengthwise edge of the first fabric strip portion whereby knitted loops from the second fabric strip portion are interlocked with the knitted loops along the edge of the first fabric strip portion. Knitting of the second fabric strip portion proceeds continuously with the use of a knitting unit, adding width to the first fabric strip portion for the entire length of the first fabric strip portion. Upon completion of the second fabric strip portion, the second fabric strip portion is made into an endless loop by joining the two widthwise edges of the strip together using a CD knitted seam. The CD seams of adjacent strip portions, however, are staggered in relation to each other. If an industrial fabric having a final width that is greater than the combined width of the first two joined fabric strip portions is required, additional fabric strip portions are knitted along the lengthwise edge of the previously knitted second fabric strip portion in a process similar to that described above until the desired width industrial fabric is achieved. Throughout this first method, knitting proceeds such that the lengthwise edges of the fabric strip portions are substantially parallel with the machine direction of the fabric.

In a second embodiment of the instant invention, a first fabric strip portion is knitted and made endless in a manner similar to that of the first embodiment. However, after the first fabric strip portion is made into an endless loop, the first fabric strip portion is wound or placed around two rotatably mounted parallel rolls such that the lengthwise edges of the fabric strip portion make an angle with the machine direction of the fabric or are not perpendicular to the central axes of the two parallel rolls, and instead are at an angle other than 90 degrees with the central axes of the two parallel rolls. Once on the rolls, knitted loops along a lengthwise edge of the first fabric strip portion are located and a loop is interlocked with a yarn from a knitting unit.

Knitting of a continuous fabric strip portion then proceeds in a continuous manner along the lengthwise edge of the first fabric strip portion by interlocking the identified knitted loops along the lengthwise edge of the first fabric strip portion with knitted loops from the continuous fabric strip portion. Knitting is performed using a knitting head that traverses back and forth in a direction parallel to the rolls. Simultaneously with the traversing knitting head, the parallel rolls are rotated such that the angled fabric strip portions traverse across the rolls away from the knitting unit. Knitting continues in this manner until the desired width of the industrial fabric is achieved. Once a fabric width greater than the desired width of the final fabric is achieved, the angled lengthwise edges of the completed fabric are trimmed in order to obtain the desired width fabric having edges that are substantially parallel to the intended machine direction of the fabric.

A third embodiment of the instant invention is a method of manufacturing full width industrial fabrics that are endless in a machine direction of the fabric. The method includes knitting a fabric strip wherein the width of the knitted fabric strip is narrower than the width of the full width fabric. The knitted fabric strip is then wound onto a supply reel. Once on the supply reel, the knitted fabric strip is spirally wound such that an edge of a first knitted fabric strip is adjacent to an edge of a subsequently wound knitted fabric strip. The spirally wound fabric strip is spirally wound about at least two parallel rolls, as taught in aforementioned U.S. Pat. No. 5,360,656. With the edges of the knitted fabric strip adjacent to one another, knitted loops along the adjacent edges of the fabric strip are located and interlocked with one another by knitting a narrow connecting section between the two adjacent edges thereby joining the adjacent fabric strips to one another.

In a further embodiment, if a warp knit is utilized for the fabric strip portions, such a knit has relatively straight "longitudinal" yarns in the MD direction of the knit. Using substantially the same method as the third embodiment, adjacent fabric strip portions can be connected to one another by interdigitating loops on adjacent edges of the spirally wound strip with one another and inserting a longitudinal yarn through the interdigitated loops.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
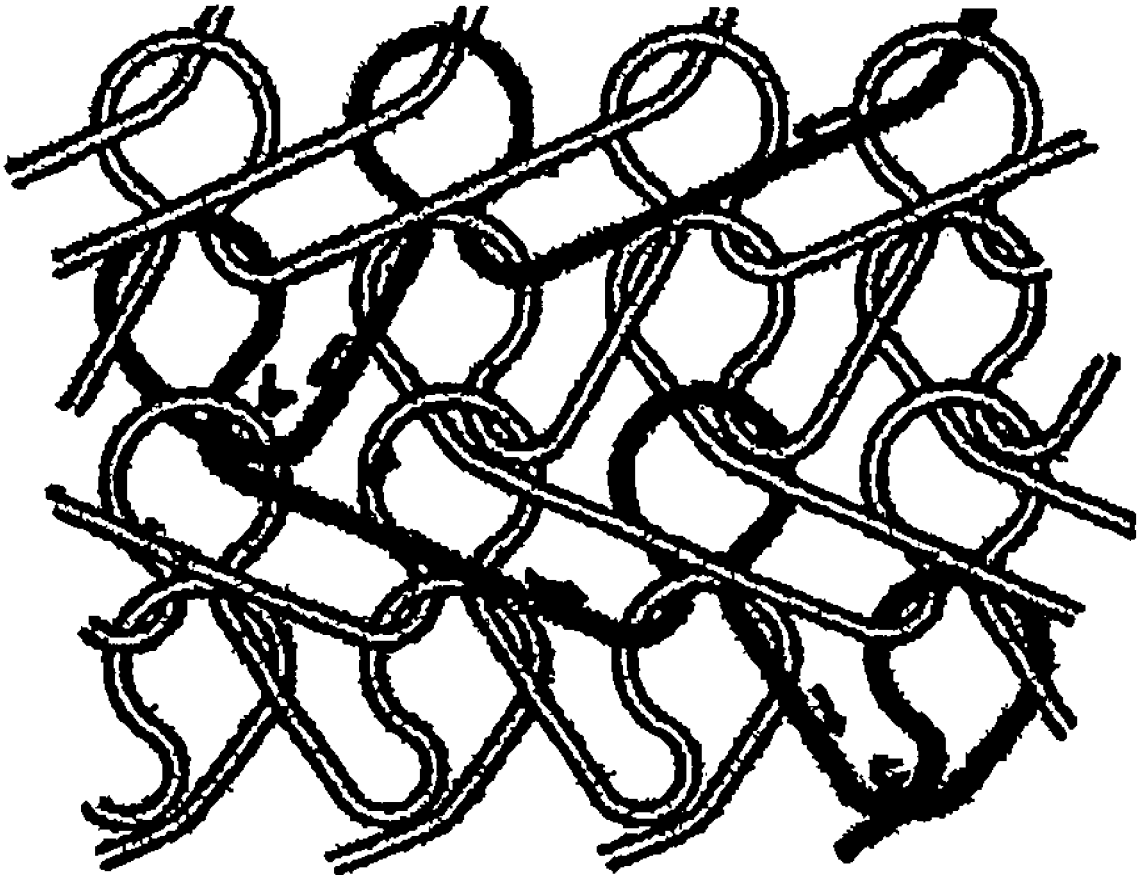
FIG. 1 is a plan view of a warp knit in the form of a tricot knitted fabric.

The instant invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The instant invention relates to full width, full length endless fabrics and substrates created using knitting technology. More specifically, the instant invention relates to fabrics and engineered fabrics used as industrial fabrics in the production of, among other things, wet laid products such as paper, paper board, carton board and sanitary tissue and towel products; in the production of wet laid and dry laid pulp; in processes related to papermaking such as those using sludge filters and chemiwashers; in the production of corrugated boxboard on corrugator machines; in the production of tissue and towel products made by through-air drying (TAD) processes; and in the production of nonwovens produced by hydroentangling (wet process), melt blowing, spunbonding, air laid or needle punching.

The instant invention offers a method of producing full width fabrics and substrates by creating fabrics produced from a narrow width process. This approach has the potential to be used as the sole process to produce a fabric, but is potentially even more useful for either producing one or more layers of a fabric structure or for being the substrate for a composite laminate structure. Fabrics formed in accordance with the instant methods will have a better sheet contact surface since interlocking knitted fabric strips results in little or no discontinuities across the entire width of the fabric since the transition between adjacent fabric strips is smoother as compared to woven fabric strips.

As used herein, the terms fabric, structure, fabric structure, and substrate are used interchangeably and are not meant to limit the use of the instant invention. Additionally, as used herein, a fabric strip portion refers to a fabric having a width W less than or narrower than the width of a final fabric. In the following description, like reference characters designate like or corresponding parts throughout the figures.

The term "industrial fabrics" also includes, but is not limited to, all other paper machine fabrics (forming, press and dryer fabrics) for transporting the fibrous slurry through the various stages of the papermaking process as well as to fabrics used in the production of fiber cement products such as fiber cement board and fiber cement pipe.

Although the instant invention relates to industrial fabrics in general, preferred embodiments of the invention will now be described in the context of full width, full length fabric structures for use in papermaking machine clothing, such as forming, press and dryer fabrics.

The fabric structures of the instant invention include a knitted component made of monofilament, plied monofilament, multifilament or plied multifilament yarns, and may be single-layered or multi-layered. The knitting process lends itself to a wide variety of materials. Polyester and polyamides are the standard materials used to produce the yarns for paper machine clothing. However, certain high modulus yarn materials, for example, are difficult to utilize in the conventional weaving processes since conventional weaving of such materials can cause damage to the yarns due to fibrillation and/or abrasion as they pass through the harnesses and reed in a weaving loom. High modulus materials, such as but not limited to, PEN (polyethylene naphthalene), polyolefins (which are made from ultra high density polyethylene and include, for example, SPECTRA®), polyaramids (such as but not limited to KEVLAR® and NOMEX®), PBO (polybenzoxazole), and metals are of particular interest for papermaking machine forming fabrics and dryer fabrics and are more apt to be used in knitting processes. Additional materials that may be used in the knitting process will be readily apparent to those skilled in the art.

Knitting is a method of constructing a fabric by interlocking a series of loops of one or more yarns or fibers. The two major classes of knitting are warp knitting and weft knitting. In the figures that are referred to when describing the different types of warp and weft knitting, it should be noted that the yarns and the spacing between the yarns in the knits are not drawn to scale.

Figure 2:
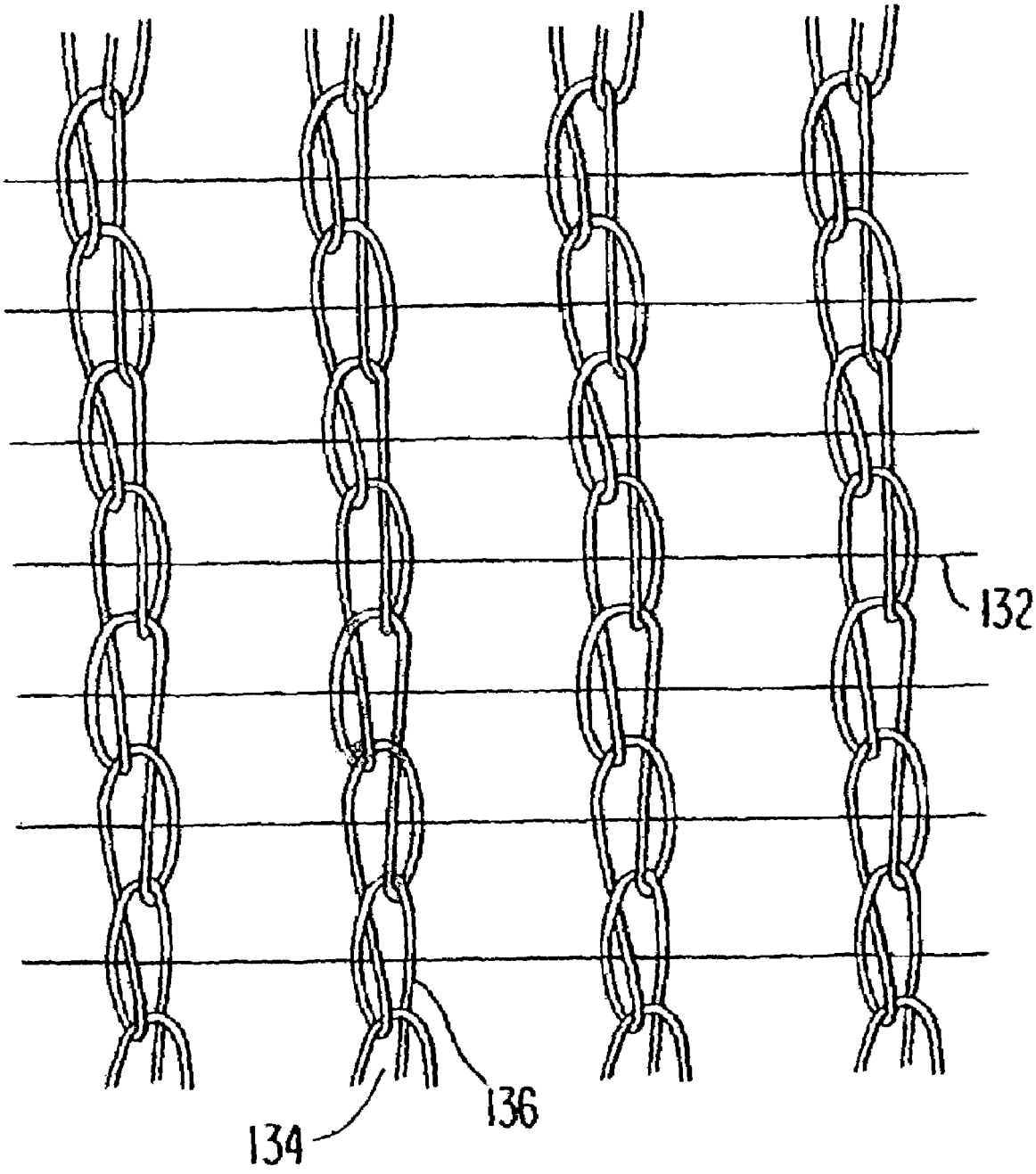
FIG. 2 is a plan view of a warp knit in the form of a raschel knitted fabric.
Figure 4:
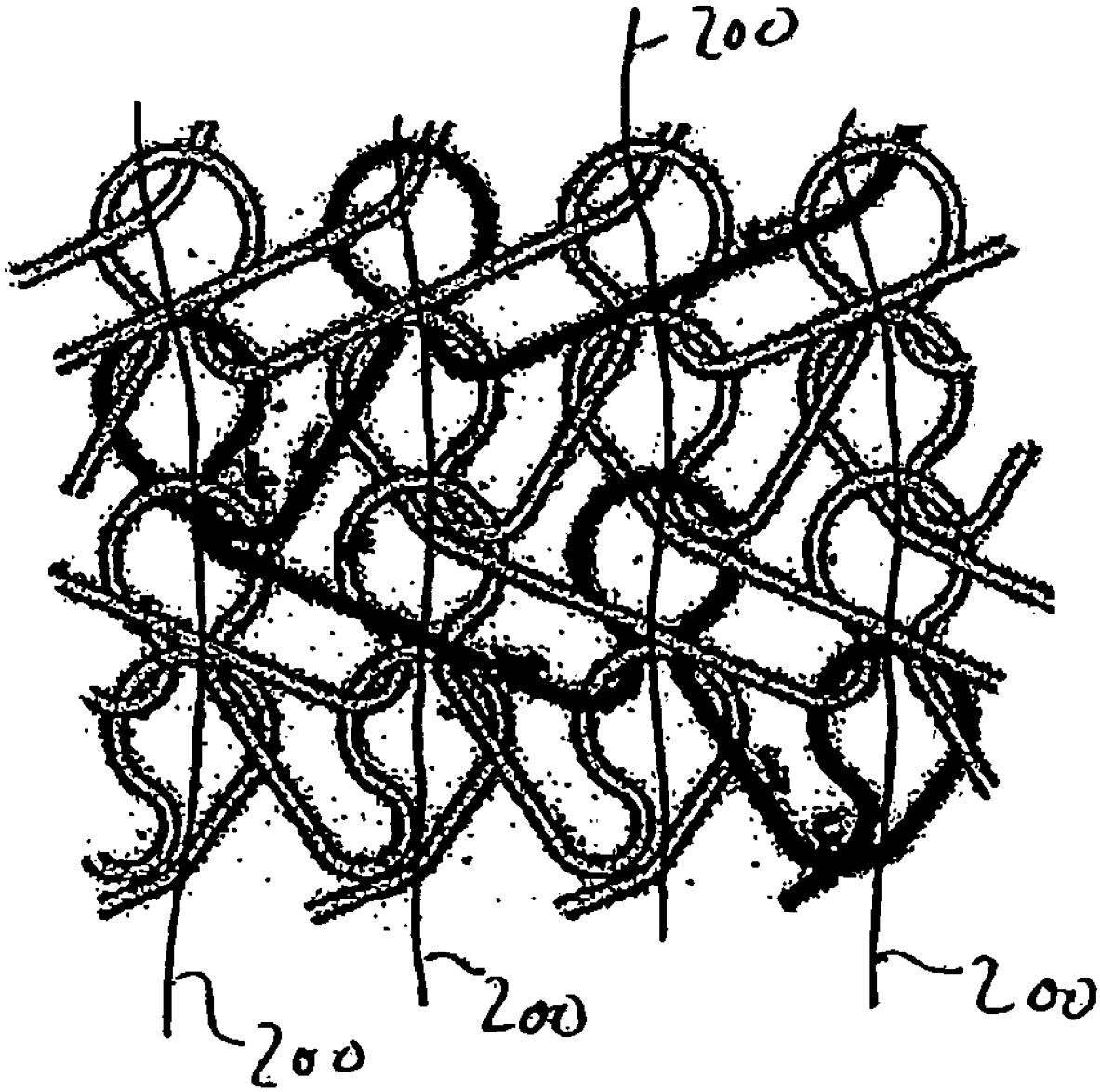
FIG. 4 is a plan view of a warp knit in the form of a tricot-knitted fabric having longitudinal yarns for machine direction reinforcement.
Figure 5:
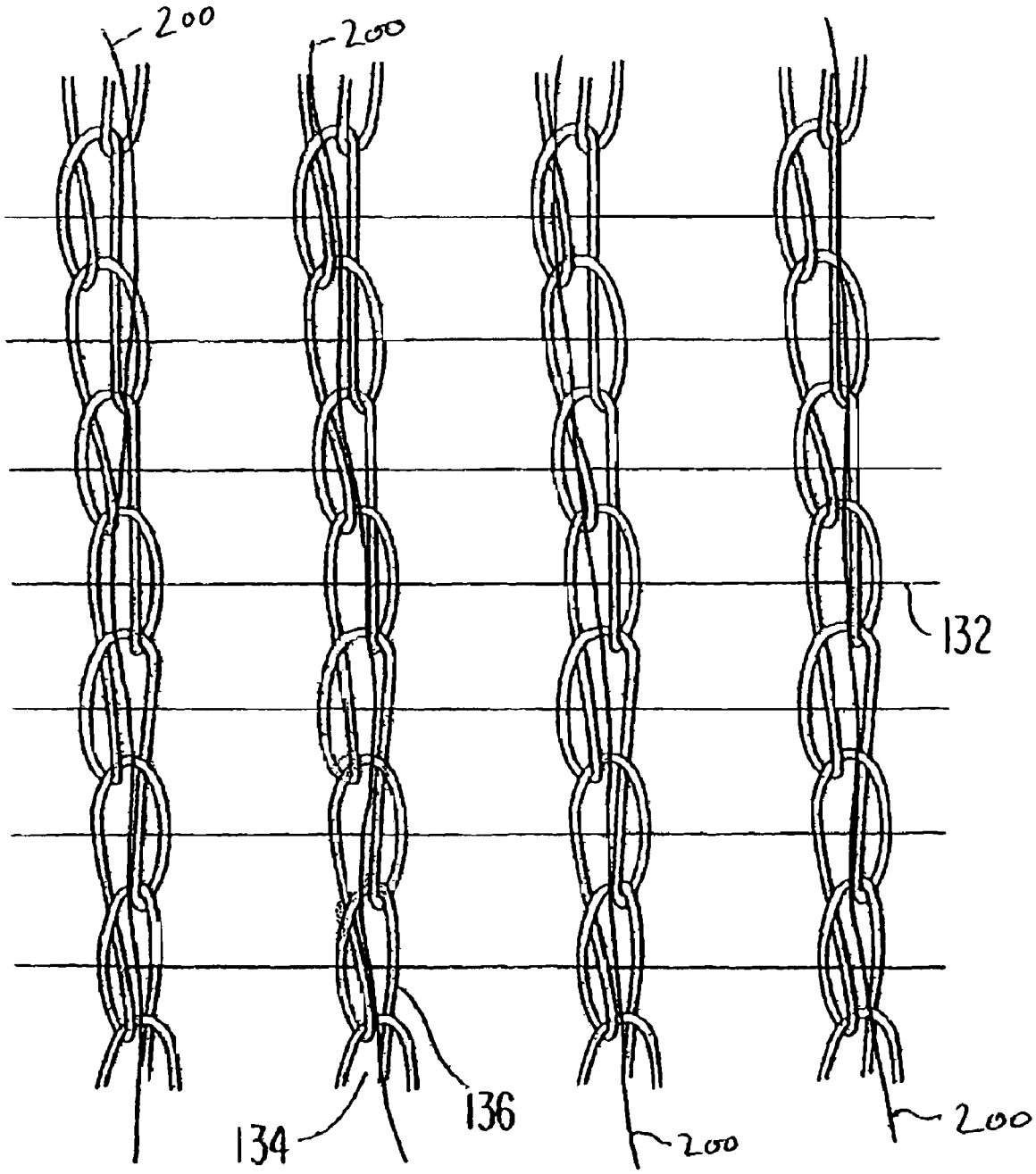
FIG. 5 is a plan view of a warp knit in the form of a raschel knitted fabric having longitudinal yarns for machine direction reinforcement.

In warp knitting, the yarns are formed into stitches in a lengthwise manner. Common examples of warp knits include tricot knits and raschel knits. A tricot knitted fabric is formed by interlooping adjacent parallel yarns as depicted in FIGS. 1 and 4. A raschel knitted fabric resembles hand crocheted fabrics, lace fabrics, and nettings. As depicted in FIGS. 2 and 5, raschel warp knits 136 contain inlaid connecting yarns 132 in addition to columns of knit stitches 134. Moreover, as depicted in FIGS. 4 and 5, the warp knits can include longitudinal yarns or inlays 200 in order to provide fabric reinforcement in the intended machine direction of the paper machine clothing. The number of longitudinal yarns 200 is dependent upon the desired amount of machine direction reinforcement to be achieved.

Figure 3:
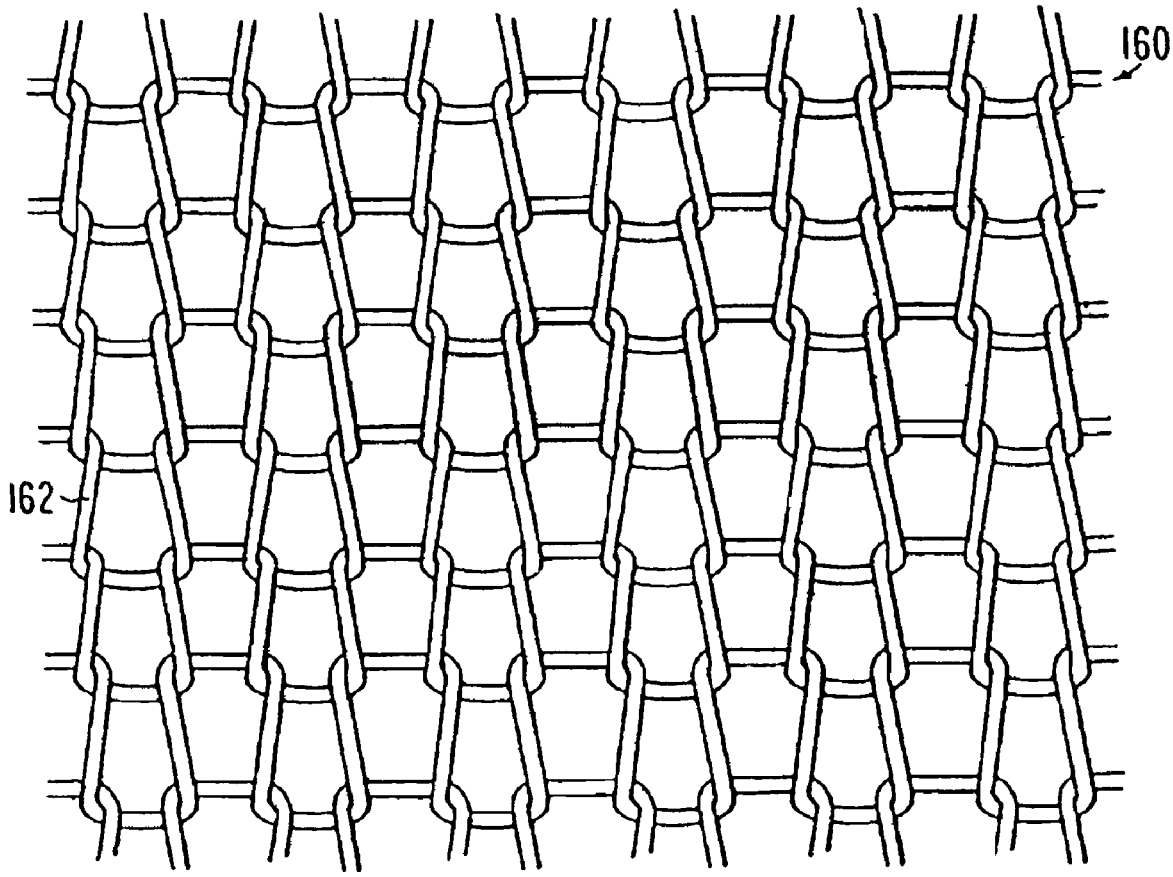
FIG. 3 is a plan view of a weft knit in the form of a flat-bed knitted fabric.
Figure 6:
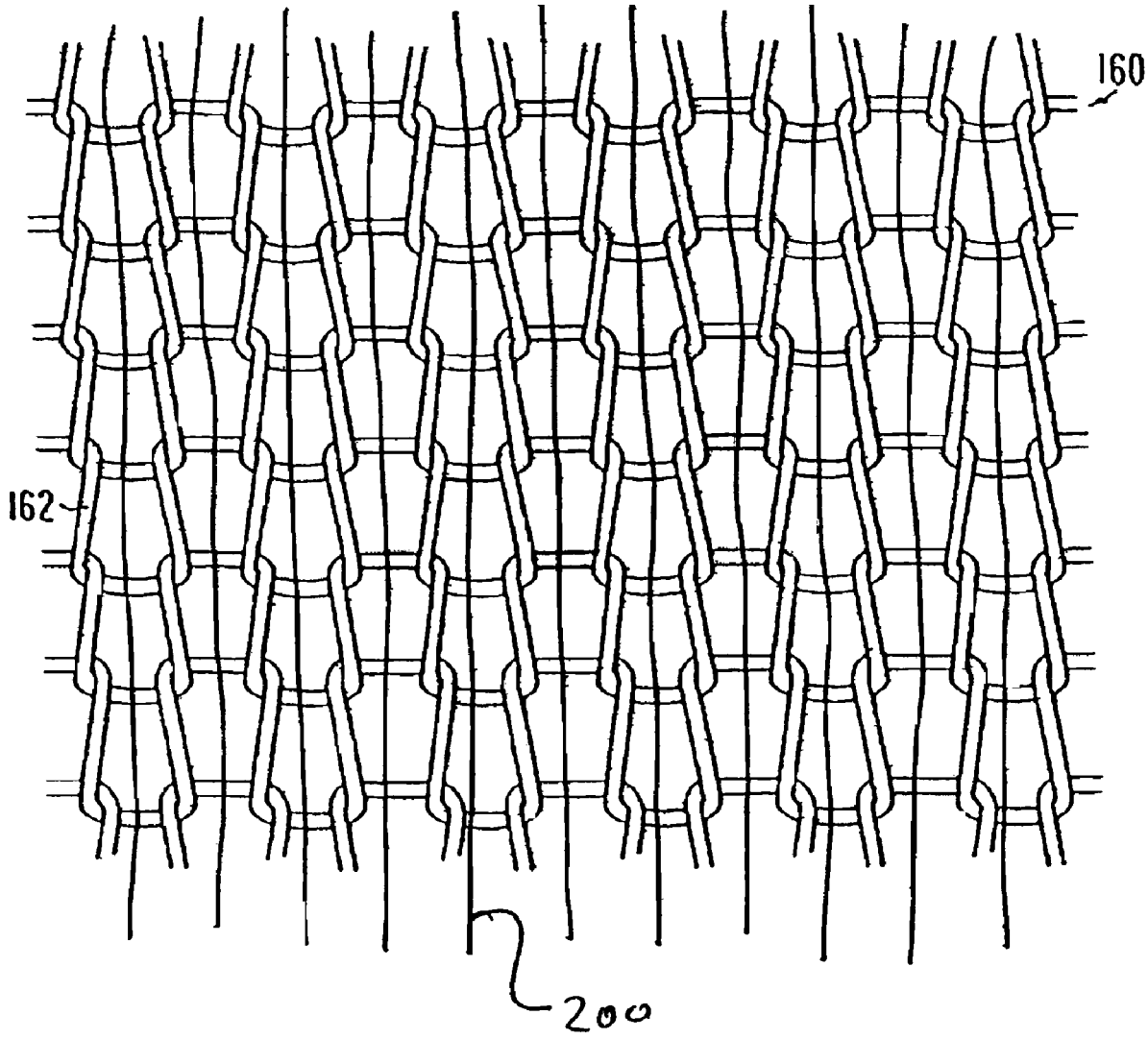
FIG. 6 is a plan view of a weft knit in the form of a flat-bed knitted fabric having longitudinal yarns for machine direction reinforcement.

In weft knitting, the yarns are formed into stitches in a widthwise manner. Common examples of weft knits include flat knits and circular knits. Flat-bed knitting is a technique whereby the product comes off the machines in one contoured sheet. Pieces are then conventionally sewn together and therefore, flat-bed knitted fabrics have a "seam" or connecting point. A flat-knit is depicted in FIGS. 3 and 6. As depicted in FIG. 6, weft knits can include longitudinal yarns 200 in order to provide fabric reinforcement in the intended machine direction of the paper machine clothing. The number of longitudinal yarns 200 is dependent upon the desired amount of machine direction reinforcement to be achieved. The instant invention is applicable to both warp and weft knitting methods.

Figure 7:
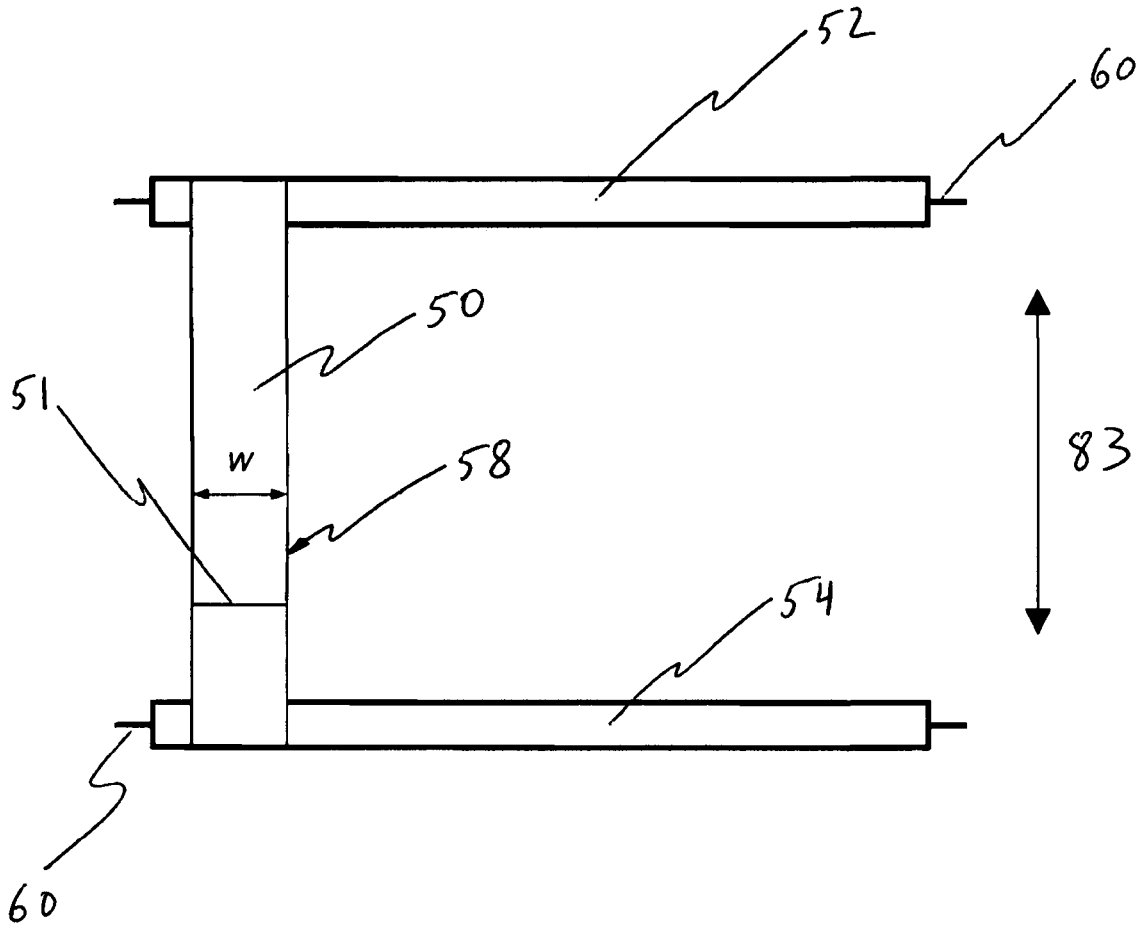
FIG. 7 is a schematic top plan view illustrating a method of manufacturing a fabric, according to one embodiment of the present invention.
Figure 8:
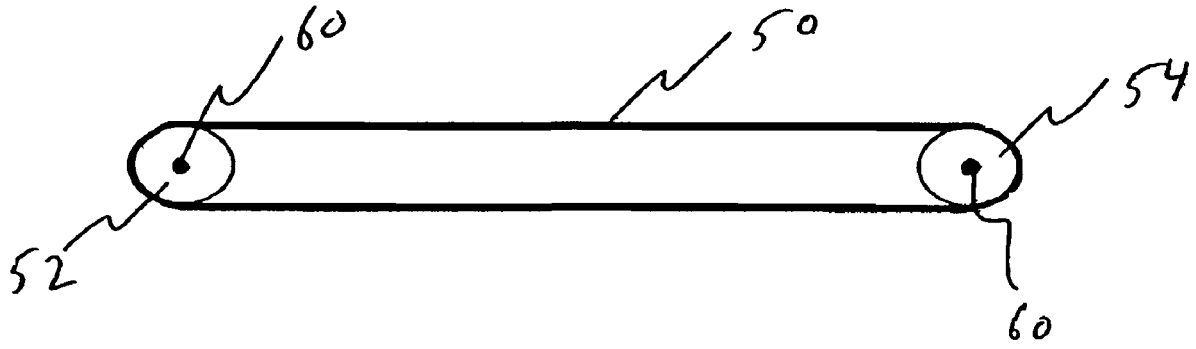
FIG. 8 is a side view of the manufacturing method illustrated in FIG. 7.

In a first embodiment of the instant invention, an industrial fabric or substrate is produced as follows. As depicted in FIG. 7, a first fabric strip portion 50 is knitted to the desired length of the industrial fabric at a width used for knitting, typically one meter. The first fabric strip portion 50 is knitted in the form of a strip having two widthwise edges (edges substantially parallel to the intended cross-machine direction of the fabric). Upon completion of the first knitted strip portion 50, the two widthwise edges are brought together and a CD seam 51 knitted, thereby joining the widthwise edges together, forming the first fabric strip portion 50 into an endless loop. Once the endless loop is formed, the first fabric strip portion 50 is wound or placed around two rotatably mounted parallel rolls 52 and 54 as depicted in FIG. 8. The first fabric strip portion 50 is wound or placed onto the two parallel rolls 52 and 54 such that the lengthwise or lateral edges 56 and 58 of the first fabric strip portion 50 are substantially parallel with the intended machine direction of the fabric, indicated by double arrow 83 in FIG. 7, or substantially perpendicular to the central axes 60 of the two parallel rolls 52 and 54.

Once wound or placed onto the two parallel rolls 52 and 54, further knitting continues along the lengthwise edge 58 of the first fabric strip portion 50. That is, knitting continues along the lengthwise edge 58 of the first fabric strip portion 50 by interlocking knitting loops of the next width or fabric strip portion being produced with knitted loops along the lengthwise edge 58 of the first fabric strip portion 50. In this manner, simultaneously with the next fabric strip portion being produced, knitting proceeds along the lengthwise edge 58 of the first fabric strip portion as a knitted continuation thereof such that the loops along the lengthwise edge of the first fabric strip portion are knitted together and interlocked with loops forming a second fabric strip portion in a seamless process. Additional fabric strip portions may be added using the above method until a desired, full size industrial fabric has been knitted. Both warp and weft knitting techniques may be used to knit the fabric strip portions associated with the first embodiment.

Figure 9:
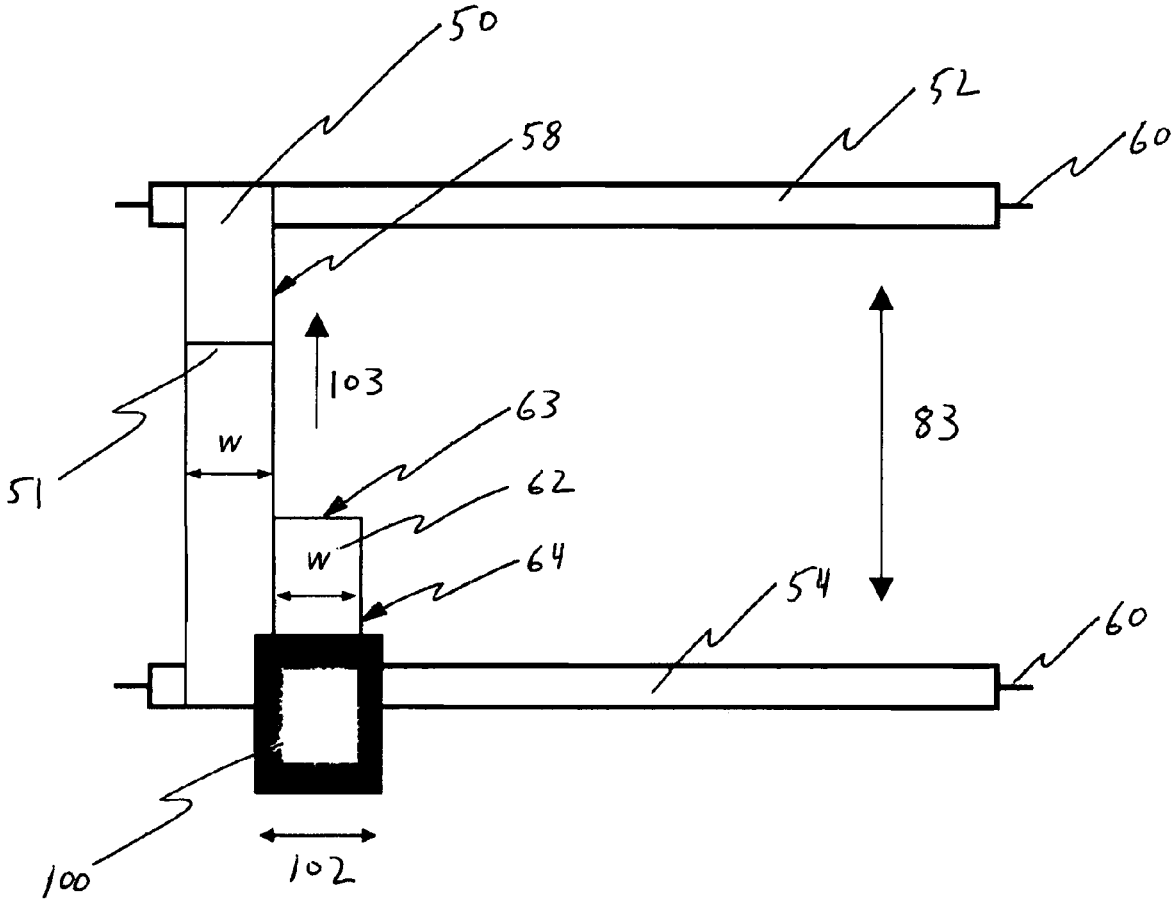
FIG. 9 is a schematic top plan view illustrating a method of manufacturing a fabric, according to one embodiment of the instant invention.

For example, as depicted in FIG. 9, a first fabric strip portion 50 is knitted to a width Wand formed into an endless loop as previously described. After knitting of the first fabric strip portion 50 is completed and the first fabric strip portion 50 is wound or placed onto the two rotatably mounted parallel rolls 52 and 54, knitting of a second fabric strip portion 62 begins along the lengthwise edge 58 of the first fabric strip portion 50, using loops along the edge 58 as a starting point for the second fabric strip portion 62 to be knitted. That is, knitting of the next strip portion 62 of the fabric proceeds by interlocking the loops along a lengthwise edge of the second fabric strip portion 62 with the loops along the lengthwise edge 58 of the first fabric strip portion 50. The second fabric strip portion 62 is then knitted in a continuous manner to a width of one meter using a knitting unit 100 having a knitting head that traverses back and forth in a direction parallel to rolls 52 and 54 as indicated by double arrow 102. This continuous knitting is accomplished as follows.

The knitting unit 100 is brought into contact with the lengthwise edge 58 of the first fabric strip portion 50. An initial loop along the lengthwise edge 58 of the first fabric strip portion 50 is identified and a yarn from the knitting head is interlocked with the loop. Once the yarn and the loop are interlocked, the knitting head commences knitting of the second strip portion 62 by traversing back and forth within the knitting unit 100 in a direction parallel to the rolls 52 and 54 as indicated by arrow 102. Simultaneously with the transverse movement of the knitting head, the rolls 52 and 54 are rotated in a direction indicated by arrow 103. As a result, as the knitting head adds width to the fabric, the rotation of the rolls 52 and 54 allows the knitting unit 100 to remain stationary with respect to the intended machine direction of the fabric (indicated by double arrow 83) while length is being added to the fabric strip portion being knitted. The speed at which the rolls 52 and 54 rotate and the speed at which the knitting head moves transversely are coordinated in order to optimize production of the fabric strip portions.

Knitting continues in this manner until the starting edge 63 of the second fabric strip portion 62 rotates around the rolls 52 and 54, back to its starting position at the knitting unit 100. At this point, the two widthwise edges of the second fabric strip portion 62 are joined by a CD knitted seam, forming the second fabric strip portion 62 into an endless loop.

The resulting fabric, for example, is now two meters wide at the desired length. To add width to the fabric, the knitting unit 100 is moved to the right in FIG. 9 where knitting proceeds along the lengthwise edge 64 of the second fabric strip portion 62 in the continuous manner previously disclosed, interlocking loops along the lengthwise edge 64 of the second fabric strip portion 62 with knitted loops along the edge of a third fabric strip portion being knitted. As will be apparent to those skilled in the art, there is no limit to the width of a knitted fabric or substrate that can be produced using the instant knitting method. Therefore, width can be added to the fabric or substrate by continuously knitting additional fabric strip portions along the lengthwise or intended machine direction edges of the previously knitted fabric strip portions in accordance with the method described above. After the desired width fabric is formed, further processing of the fabric occurs thereafter, i.e. coatings, application of a needled batt, etc.

It is important to note that the CD knitted seams of adjacent fabric strip portions are constructed so they are staggered in relation to each other. This can be accomplished, for example, by advancing the completed knitted fabric strip portions on the rolls 52 and 54 prior to knitting of a new fabric strip portion, such that the previously knitted adjacent CD seam is positioned away from the rolls and the knitting unit 100.

Figure 10:
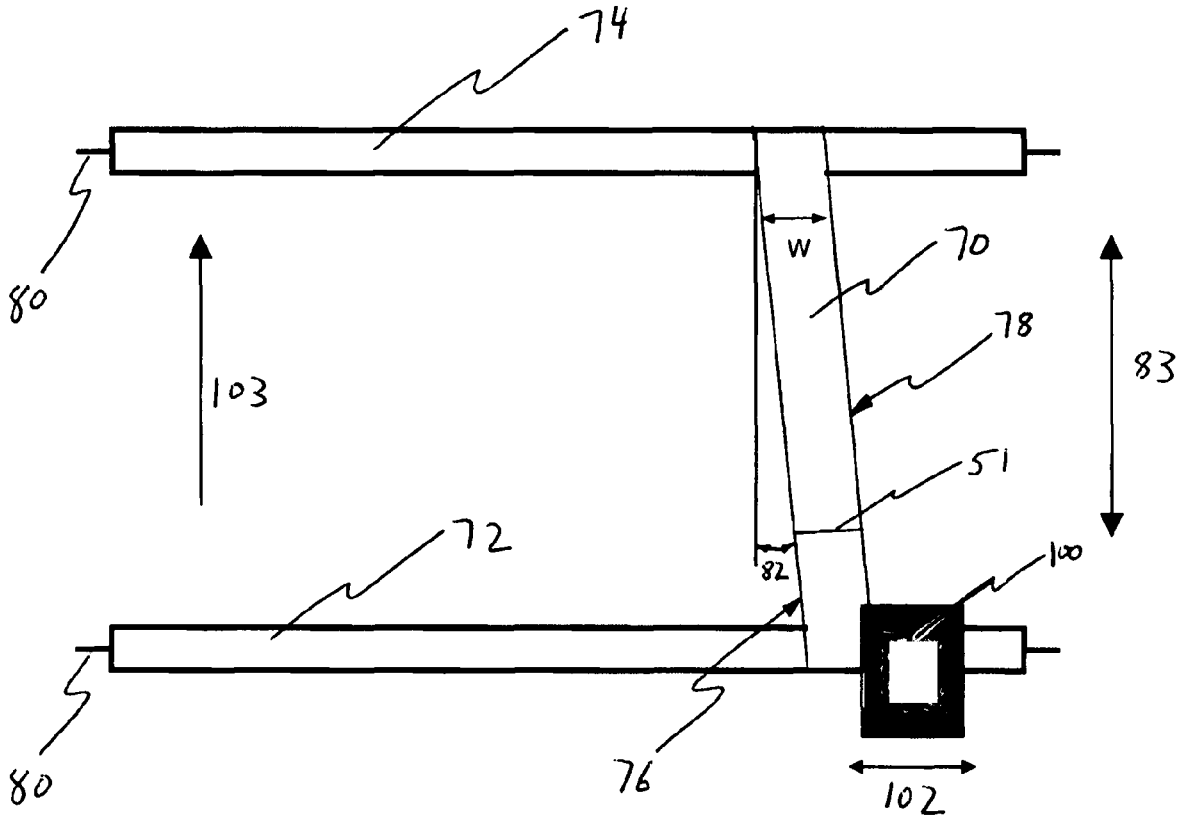
FIG. 10 is a schematic top plan view illustrating a method of manufacturing a fabric, according to one embodiment of the instant invention.

In a second embodiment depicted in FIG. 10, a first fabric strip portion or starter strip 70 is first knitted to a length of the final completed industrial fabric. The first fabric strip portion or starter strip 70 is knitted in the form of a strip having two widthwise edges (edges substantially parallel to the intended cross-machine direction of the fabric). Upon completion of the first fabric strip portion 70, the two widthwise edges are brought together and a CD seam 51 knitted, thereby joining the widthwise edges together, forming the first fabric strip portion 70 into an endless loop. Once the endless loop is formed, the first fabric strip portion 70 is wound or placed around two rotatably mounted parallel rolls 72 and 74 toward the right side of the rolls 72 and 74 as depicted in FIG. 10. The first fabric strip portion 70 is wound or placed onto the two parallel rolls 72 and 74 such that the lengthwise or lateral edges 76 and 78 of the first fabric strip portion 70 are not perpendicular to the central axes 80 of the two parallel rolls 72 and 74. Instead, the first fabric strip portion 70 is positioned such that the lengthwise edges 76 and 78 make an angle 82 with the intended machine direction (indicated by double arrow 83) of the fabric.

Figure 10A:
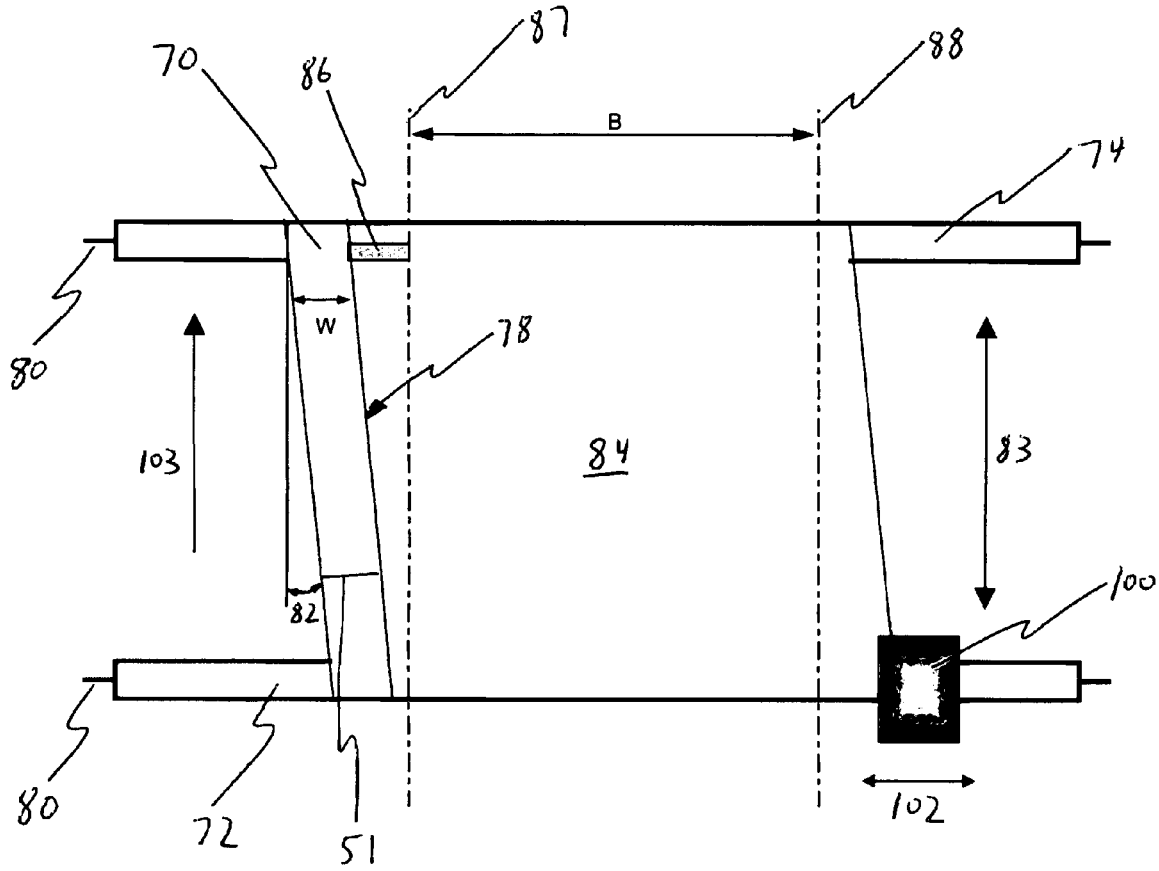
FIG. 10A is a schematic top plan view illustrating a method of manufacturing a fabric, according to one embodiment of the instant invention.

As depicted in FIGS. 10 and 10A, once wound or placed onto the two parallel rolls 72 and 74, further knitting continues along lengthwise edge 78 of the first strip portion 70. That is, knitting continues along lengthwise edge 78 of the first strip portion 70 by interlocking knitted loops of the continuous strip portion 84 being produced with knitted loops along the lengthwise edge 78 of the first knitted strip portion 70. This process proceeds as follows.

A knitting unit 100 is brought into contact with the lengthwise edge 78 of the first fabric strip portion 70. An initial loop along the lengthwise edge 78 of the first fabric strip portion 70 is identified and a yarn from the knitting head within the knitting unit 100 is interlocked with the initial loop. Once the yarn and the loop are interlocked, the knitting head commences knitting of a continuous strip portion 84, by traversing back and forth within the knitting unit 100 in a direction parallel to the rolls 72 and 74 as indicated by double arrow 102. Simultaneously with the transverse movement of the knitting head, the rolls 72 and 74 rotate in a direction indicated by arrow 103. As the rolls 72 and 74 rotate, the angled positioning or orientation of the first fabric strip portion 70 on the rolls causes the strip portion 70 to move along the rolls away from the knitting unit 100 or to the left in the figures. This movement or traversing of the first fabric portion 70 across the rolls 72 and 74 away from the knitting unit 100, allows the knitting unit 100 to remain stationary in both the intended machine and cross-machine direction of the fabric while length and width are simultaneously being added to the continuous fabric strip portion 84.

The rate at which the strip portions traverse across the rolls 72 and 74 is affected by the angle that the first fabric strip portion 70 makes with the intended machine direction and the speed at which the rolls 72 and 74 rotate. Furthermore, the speed at which the rolls 72 and 74 rotate and the speed at which the knitting head moves transversely are coordinated in order to maximize production of the strip portions.

As can be seen in FIG. 10A, a fabric produced in accordance with the second embodiment will have a first fabric portion or starter strip 70 with a CD seam 51 connected to a continuous strip portion 84. The transverse movement of the strip portions across the rolls 72 and 74, allows the continuous strip portion 84 to be knitted in a continuous manner, which results in the continuous strip portion 84 having no machine direction or cross-machine direction seams, which is very desirable. There may, however, be a small portion 86 of the continuous strip portion 84 where knitting began that is not connected in the machine direction, which may at some point be connected with a CD knitted seam.

Alternatively, since the angled lengthwise edges of the resulting fabric will be trimmed along dashed lines 87 and 88 to obtain a final fabric having a width B and lengthwise edges that are parallel to the intended machine direction of the fabric, unconnected portion 86 may be included in the trimmed off edges, which will also include first fabric strip portion 70, resulting in a final fabric that has no seams in either the machine or cross-machine directions. In order to minimize material waste, the first fabric strip portion or starter strip 70 may have a narrow width W. Further processing of the fabric occurs thereafter, i.e. coatings, application of a needled batt, etc. Both warp and weft knitting techniques may be used to knit the strip portions associated with the second embodiment.

Figure 11:
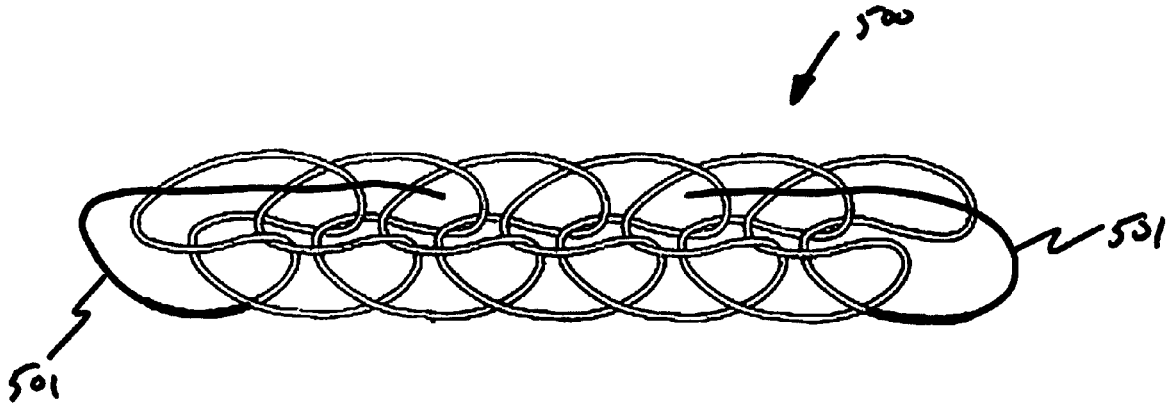
FIG. 11 is a side view of a knit fabric, according to one embodiment of the instant invention.
Figure 12:
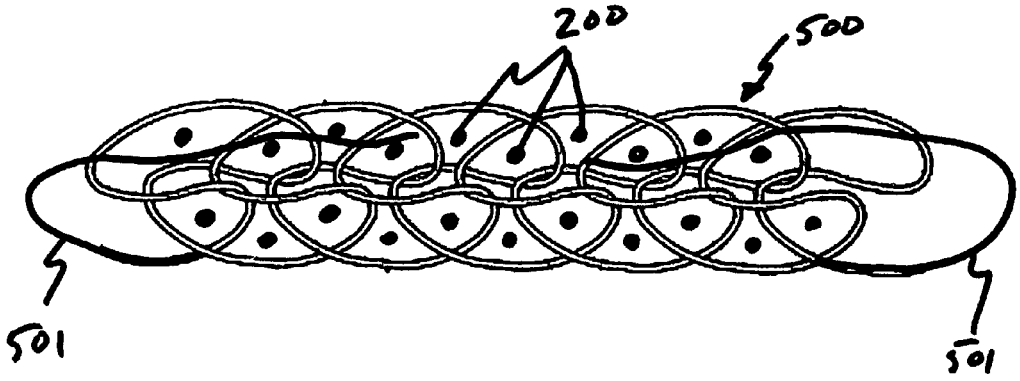
FIG. 12 is a side view of a knit fabric having longitudinal yarns for machine direction reinforcement, according to one embodiment of the instant invention.

As depicted in FIGS. 11 and 12, which show a fabric with and without longitudinal reinforcing yarns 200, a fabric constructed in accordance with the first two embodiments of the instant invention results in a continuously knitted fabric 500 that has uniform fabric characteristics across the entire width of the fabric. As such, there is no seam present where additional strip portions have been added to achieve a desired width fabric. The loose yarns or "tails" 501 along the edges of the fabric 500 are knitted back into the body of the fabric, thereby finishing the edges of the fabric 500. This method is also used when dealing with the loose ends or "tails" 501 of the fabric strip portions. By this method, as depicted throughout the figures, joining loops 600 are also formed along the edges of the strip portions by the loose ends or "tails" 501 that are knitted back into the main or central regions of the strip portions.

With the methods associated with the first and second embodiments of the instant invention, tension control is important due to the nature of a knit fabric as compared to a woven structure. In a knit fabric, the yarns do not interlock in the final set position until the fabric is tensioned. Therefore, both MD and CD tensioning may be necessary. Additionally, it may be desirable to stabilize the knitted fabric or structure through bonding at the fiber or yarn contact points. One bonding method is to include a meltable fiber or yarn in the knitted fabric and heat-set the structure.

Another bonding method is to pass the knitted fabric through a latex or photopolymer solution and supply either thermal or photo energy, respectively, to bond and stabilize the knitted structure. These techniques are likely to be performed after the final full width fabric is constructed, but could also be performed on the knitted fabric strips as they are produced. One of the advantages of this approach is that it provides a stiffer structure along the lengthwise edges of the fabric strips making it easier to knit the lengthwise edges together.

Figure 13:
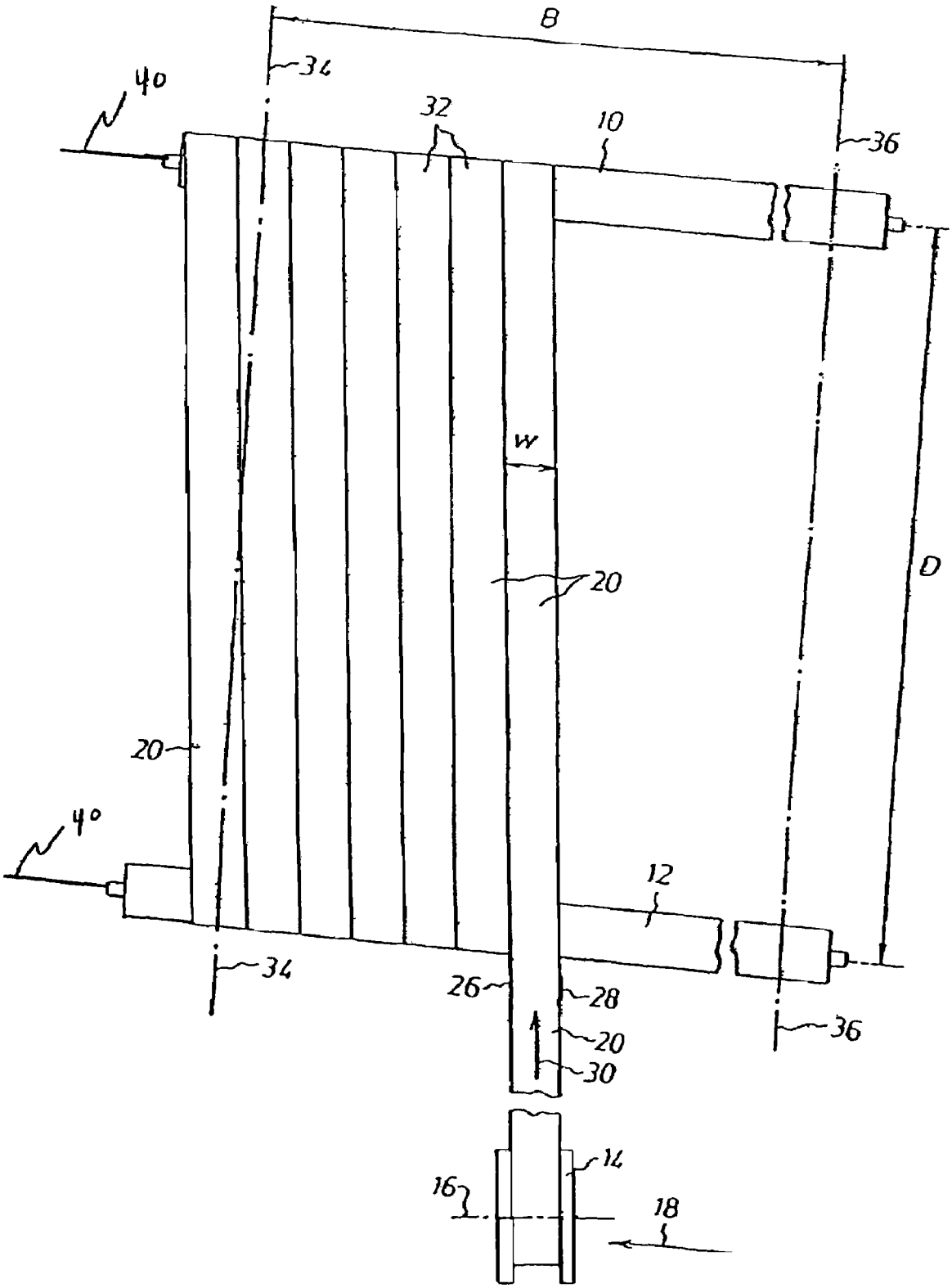
FIG. 13 is a schematic top plan view illustrating a method of manufacturing a fabric, according to one embodiment of the instant invention.

In a third embodiment of the instant invention, the final width knitted fabric can be produced from a continuous roll of a narrow knitted fabric strip using the method in aforementioned U.S. Pat. No. 5,360,656. As depicted in FIG. 13, two rotatably mounted rolls 10 and 12 are positioned so that their axes are parallel and spaced apart from each other by a distance D. At the side of one roll 12, there is provided a supply reel 14 rotatably mounted about an axis 16 and displaceable parallel to the rolls 10 and 12, as indicated by the double arrow 18. The supply reel 14 accommodates a supply of a knitted fabric strip of yarn material 20 having a width W. The strip 20 has two longitudinal edges 26 and 28. The knitted fabric strip 20 can be knitted using either warp or weft knitting techniques and can include longitudinal yarns 200 for reinforcement in the intended machine direction as depicted in FIGS. 3-6. Again, the number of longitudinal yarns 200 is dependent upon the desired longitudinal reinforcement to be achieved.

Figure 14:
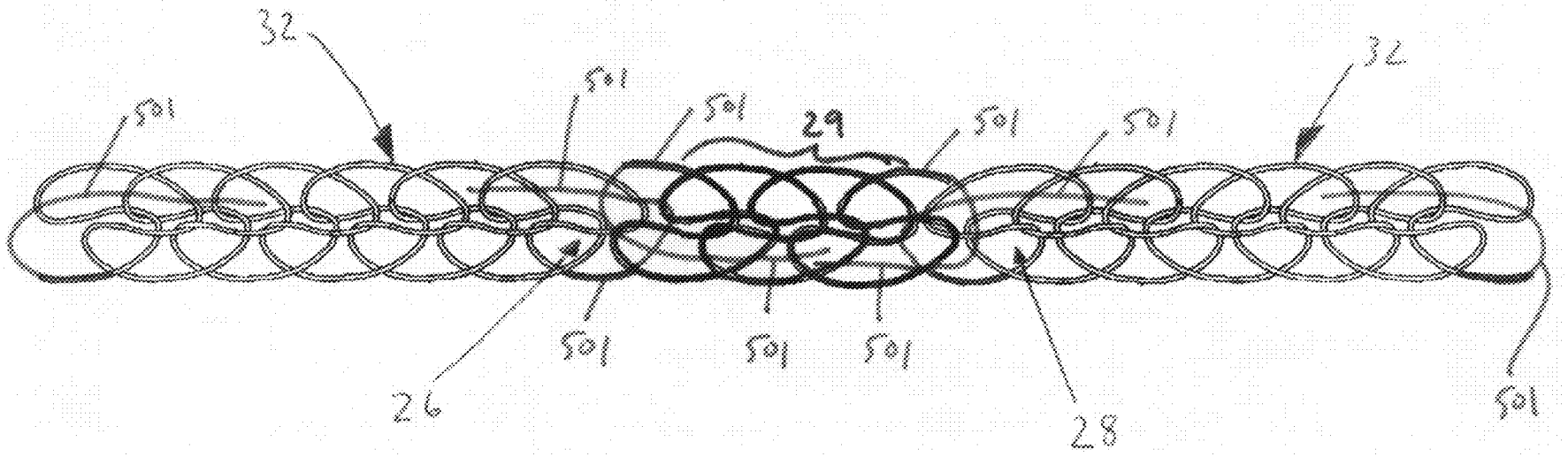
FIG. 14 is a side view of a joined knit fabric, according to one embodiment of the instant invention.

The supply reel 14 is initially applied at the left-hand end of the roll 12 before being continuously displaced to the right at a synchronized speed. As the supply reel 14 is displaced sideways, the strip 20 is dispensed, as indicated by an arrow 30, to be wound spirally about the rolls 10 and 12 into a "tube" having a closed circumferential surface. The strip 20 is placed around the rolls 10 and 12 with a certain pitch angle, which in the illustrated embodiment is assumed to be so adapted to the strip width W, the distance D between the roll axes and the diameters of the rolls 10 and 12, such that the longitudinal edges 26 and 28 of adjacent "spiral turns" 32 are placed edge to edge (see FIG. 14), and the knitted loops on the lengthwise edges of the fabric strips interlocked with one another and joined together by knitting a narrow connecting section 29 so as to provide a smooth transition between the spiral turns 32, resulting in no discontinuity across the width of the final fabric. As shown in FIG. 14, the loose ends or "tails" 501 along the edges 26 and 28 of the adjacent spiral turns 32 and the "tails" 501 along the edges of the connecting section 29, are knit through the adjacent structures and run back into the main or central portions of their respective fabric structures, thereby connecting the adjacent structures to one another.

The number of spiral turns 32 placed on the rolls 10 and 12 is dependent on the desired width B of the final fabric. To prevent the spiral turns 32 already wound on the rolls 10 and 12 from shifting on the rolls, it is possible, if so required, for instance to fix the first turn 32 in the longitudinal direction of the rolls. After the spiral winding operation is completed, the edges of the resulting base fabric are cut along the dashed lines 34 and 36 in FIG. 13 to obtain the width B. Further processing of the fabric occurs thereafter, i.e coatings, etc. The length of the final base fabric is essentially twice the distance D between the roll axes and can therefore easily be varied by changing the distance D. These substrates that are now the required length and width can be the final fabric itself or can be a layer in a laminate of some type.

Figure 15:
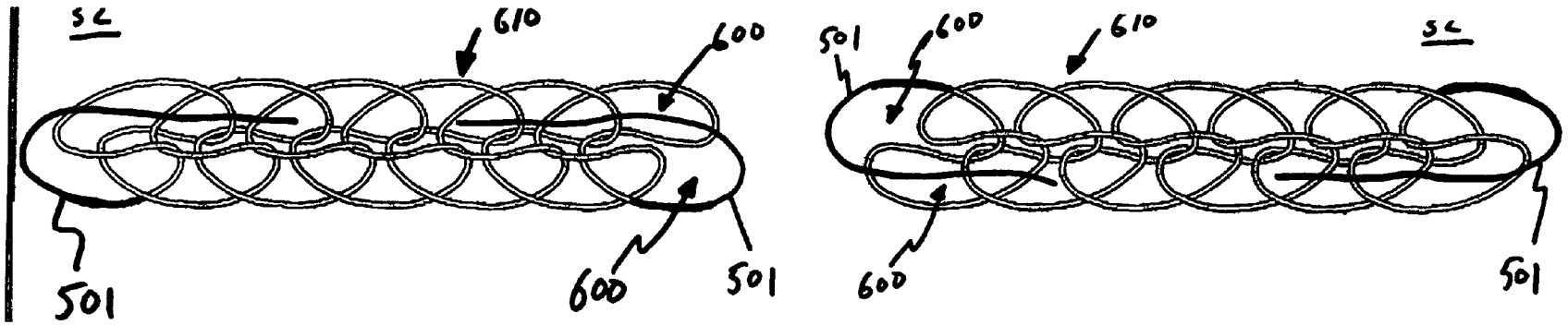
FIG. 15 is a side view of adjacent spiral turns depicting lateral edge loops, according to one embodiment of the instant invention.
Figure 16:
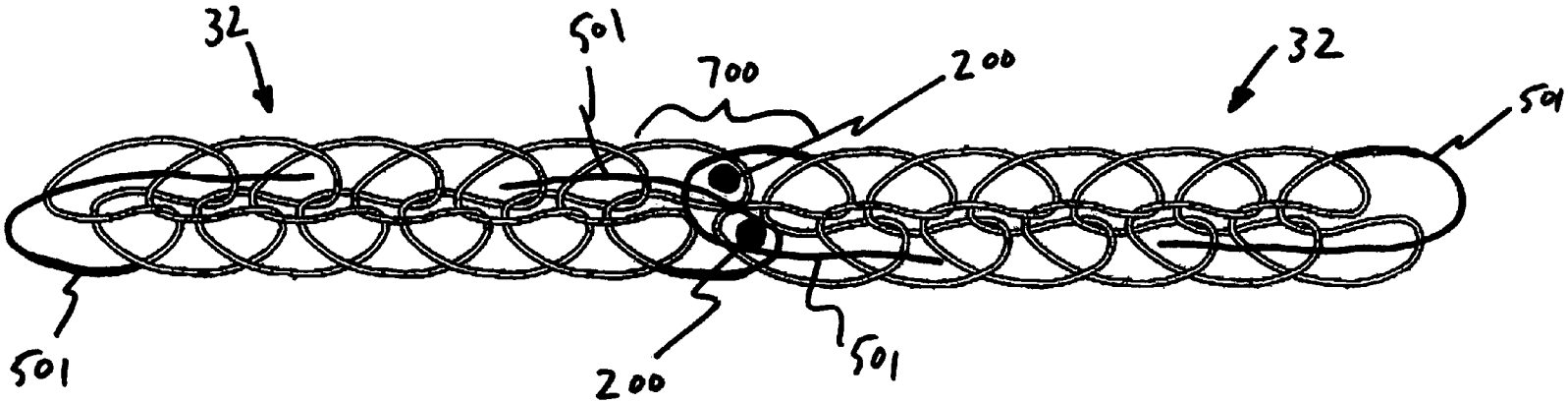
FIG. 16 is a side view of a fabric having joined adjacent spiral turns, according to one embodiment of the instant invention.
Figure 17:
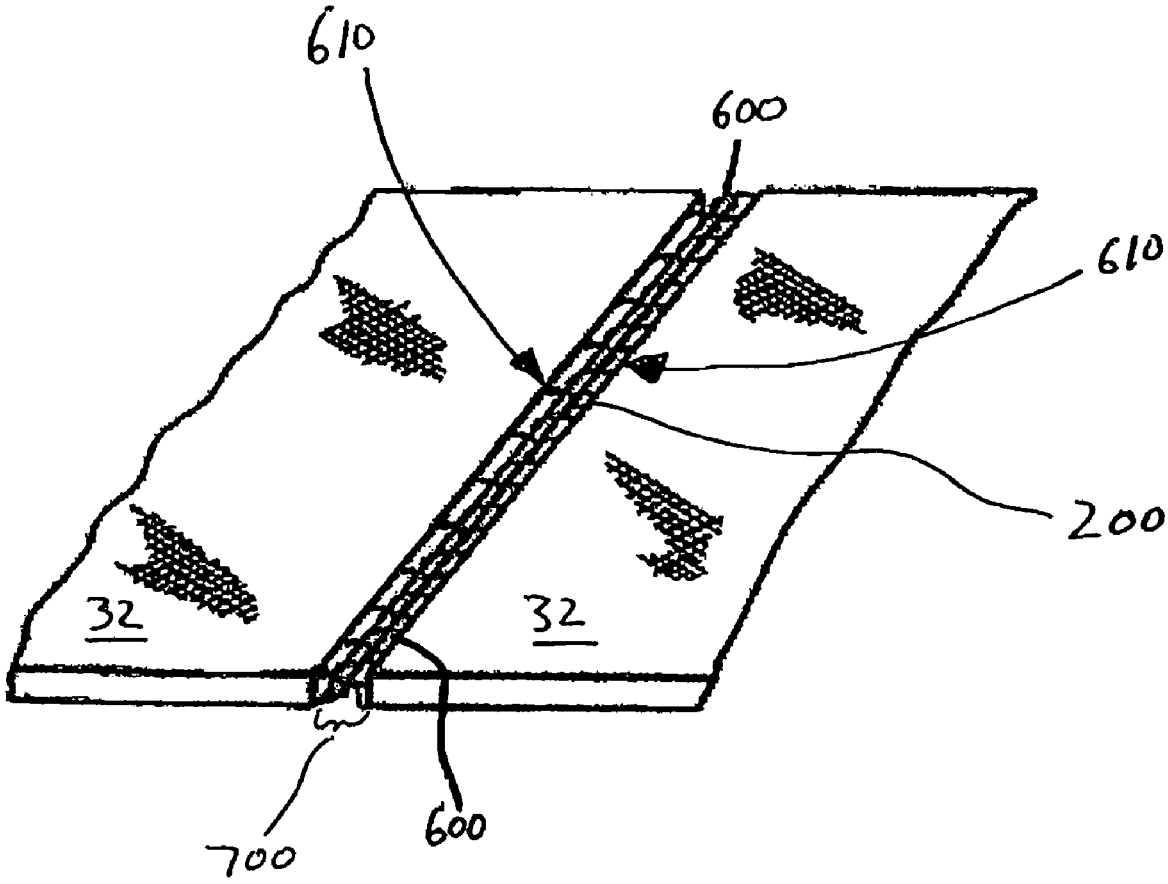
FIG. 17 is a top perspective view of a fabric having joined adjacent spiral turns, according to one embodiment of the instant invention.
Figure 18:
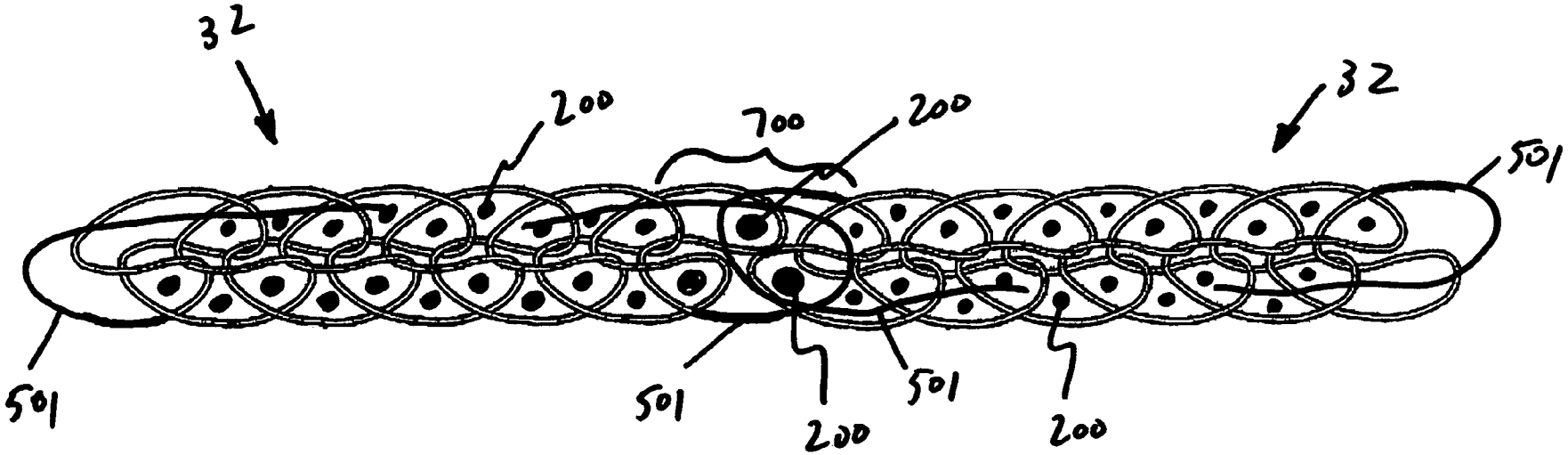
FIG. 18 is a side view of a fabric having joined adjacent spiral turns and longitudinal yarns for machine direction reinforcement throughout the entire fabric, according to one embodiment of the instant invention.

In a variation on the third embodiment, an additional method for attaching the adjacent spiral turns 32 is as follows. As depicted in FIGS. 15-17, knitted loops 600 formed during the initial knitting process and by knitting the loose ends or "tails" 501 back into the main or central portion of the spiral turn, are located along the lateral edges 610 of adjacent spiral turns 32. Once located, the knitted loops 600 along the edges 610 of the adjacent spiral turns 32 are interdigitated or intermeshed together as depicted at 700 in FIG. 16. Once interdigitated, longitudinal yarns 200 are inserted into the interdigitated loops of the adjacent edges, thereby connecting the adjacent spiral turns of the knitted fabric strip together. Using this variation, however, usually requires that the fabric strip be knitted using a warp knitting technique to achieve the uniformity aspect of the connecting area compared to the knitted strips themselves. In addition, as disclosed above and depicted in FIG. 18, the body of the fabric strip can be reinforced throughout with longitudinal yarns 200 in order to provide reinforcement in the machine direction as well as uniform fabric characteristics across the entire width of the fabric, including the connection points between the adjacent spiral turns resulting in a final width fabric that appears to be "seamless."

Critical to joining the knitted fabric strips or strip portions using any of the previously disclosed methods is locating the knitted loops along the adjacent lengthwise edges of the knitted fabric strips to be joined. There are, however, systems in the art, such as systems that use ultraviolet (UV) sensitive dyes, which can be easily adapted by a person of ordinary skill to meet the needs of the instant process or method to assist in locating and aligning adjacent loops.

Knitted structures produced using the methods of the instant invention have the potential to achieve many of the same basic design characteristics of woven structures. Important design characteristics include hole (void) size, fabric caliper or thickness, hole (void) density and open area. In some uses such as for papermaking press fabrics, knits by their nature can be much more compressible than woven structures. They can also be more resilient. That is, after removal of a press load in a press nip, the fabric can expand back to its original, uncompressed thickness.

Joined knitted structures produced using the methods of the instant invention may be made into many of the same functional constructions as woven fabrics with knitted structures being desired over woven structures because of the previously discussed advantages that knitted structures provide over woven structures. For instance, multilayer fabrics can be produced where the top layer is designed for smoothness and fine pore size, while the bottom layers are designed for abrasion resistance, toughness, strength, and MD and/or CD stability. Unlike in prior art methods using woven fabric strips, it is possible to have a subassembly approach for producing a thin, fine, high modulus fabric. This may be possible with the joined knitted structure itself, since this joining method will result in a non-marking, strong connecting point and means. It is envisioned, however, that the joined knitted structure will just as likely be the base structure used to produce a composite or an ultra fine structure that produces such a structure.

While construction of a single layer fabric has been described, laminated fabrics including several fabric layers may be produced, wherein one or more, including all of the fabric layers may be on-machine-seamable. Moreover, a knitted substrate that is on-machine seamable may also be desired. Furthermore, the fabric described above could be produced as is without any further treatments. Or, in the case where the fabric is a press fabric, such fabric may be produced as a substrate, needled with one or more layers of staple fiber batt material on one or both sides. The fabric may also be coated and/or impregnated with one or more polymer resin layers using well-known methods in the art and used for example as a shoe press belt.

Although a preferred embodiment of the present invention and modifications thereof have been described in detail herein, it is to be understood that this invention is not limited to this precise embodiment and modifications, and that other modifications and variations may be effected by one skilled in the art without departing from the spirit and scope of the invention as defined by the appended claims.

What is claimed is:

1. A method of manufacturing an industrial fabric, said method comprising the steps of:

knitting a first fabric strip portion having two widthwise edges to the desired length of the industrial fabric, wherein said first fabric strip portion has a width that is narrower than the industrial fabric;

forming said first fabric strip portion into an endless loop by knitting a CD seam thereby joining said two widthwise edges together;

placing said first endless loop fabric strip portion around two rotatably mounted parallel rolls; and knitting a second fabric strip portion wherein the knitting of said second fabric portion proceeds along a first edge of said first fabric strip portion as a continuation thereof and wherein said second fabric strip portion is continuously knitted as an endless loop.

2. The method as claimed in claim 1, further comprising the steps of knitting additional fabric strip portions as endless loops having widths that are narrower than the industrial fabric, wherein knitting of said additional fabric strip portions proceeds continuously along an edge of a previously knitted fabric strip portion by knitting and interlocking knitting loops from a first edge of an additional fabric strip portion with knitting loops from a second edge of a previously knitted fabric strip portion and wherein said additional fabric portions are knitted in order to form a desired width of the industrial fabric.

3. The method as claimed in claim 1, wherein said first fabric strip portion and said second fabric strip portion are knitted using a warp or weft knitting technique.

4. The method as claimed in claim 2, wherein said first fabric strip portion, said second fabric strip portion and said additional fabric strip portions are knitted using a warp or weft knitting technique.

5. The method as claimed in claim 3, wherein said knitted fabric strip portions include a longitudinal reinforcing yarn.

6. The method as claimed in claim 4, wherein said warp knitted fabric strip portions and said weft knitted fabric strip portions include a longitudinal reinforcing yarn.

7. The method as claimed in claim 1, wherein said first fabric strip portion is placed around said two rotatably mounted parallel rolls and wherein lengthwise edges of said first fabric strip portion are parallel with an intended machine direction of said first fabric strip portion.

8. The method as claimed in claim 1, wherein said first fabric strip portion is placed around said two rotatably mounted parallel rolls and wherein lengthwise edges of said first fabric strip portion make an angle with an intended machine direction of said first fabric strip portion.

9. A method of manufacturing a full width industrial fabric, wherein said fabric is endless in an intended machine direction of said fabric, said method comprising the steps of:

knitting a fabric strip comprising monofilament or multifilament fibers, wherein a width of said knitted fabric strip is narrower than a width of said full width fabric;

spirally winding said knitted fabric strip, wherein an edge of said knitted fabric strip is adjacent to an edge of a subsequently wound knitted fabric strip;

locating knitting loops along said adjacent edges of said wound knitted fabric strip; and interlocking said knitting loops on said adjacent edges of said knitted fabric strip, wherein said knitting loops are interlocked by knitting a narrow connecting section between said adjacent edges, thereby joining said knitting loops to one another.

10. The method as claimed in claim 9, wherein the step of spirally winding said knitted fabric strip is performed by spirally winding said knitted fabric strip about at least two parallel rolls.

11. The method as claimed in claim 9, wherein said knitted fabric strip is knitted using a warp or weft knitting technique.

12. The method as claimed in claim 9, wherein said knitted fabric strip includes a longitudinal reinforcing yarn.

13. A method of manufacturing a full width industrial fabric, wherein said fabric is endless in an intended machine direction of said fabric, said method comprising the steps of:

knitting a fabric strip comprising monofilament or multifilament fibers, wherein a width of said knitted fabric strip is narrower than a width of said full width fabric;

spirally winding said knitted fabric strip, wherein an edge of said knitted fabric strip is adjacent to an edge of a subsequently wound knitted fabric strip;

locating knitting loops along said adjacent edges of said wound knitted fabric strip;

interlocking said knitting loops on said adjacent edges of said knitted fabric strip;

interdigitating said knitting loops along said adjacent edges of said wound knitted fabric strip; and inserting a longitudinal yarn into the interdigitated loops, thereby connecting the edges of said wound knitted fabric strip together.

14. The method as claimed in claim 13, wherein said knitted fabric strip is knitted using a warp knitting or a weft knitting technique.

15. The method as claimed in claim 13, wherein said knitted fabric strip includes a longitudinal reinforcing yarn.

16. An industrial fabric produced by:

knitting a first fabric strip portion having two widthwise edges to a desired length of the industrial fabric, wherein said first fabric strip portion has a width that is narrower than the industrial fabric;

forming said first fabric strip portion into an endless loop by knitting a CD seam thereby joining said two widthwise edges together;

placing said first endless loop fabric strip portion around two rotatably mounted parallel rolls; and knitting a second fabric strip portion wherein the knitting of said second fabric portion proceeds along a first edge of said first fabric strip portion as a continuation thereof and wherein said second fabric strip portion is continuously knitted as an endless loop.

17. An industrial fabric produced by:

knitting a fabric strip comprising monofilament or multifilament fibers, wherein a width of said knitted fabric strip is narrower than a width of said full width fabric;

spirally winding said knitted fabric strip, wherein an edge of said knitted fabric strip is adjacent to an edge of a subsequently wound knitted fabric strip;

locating knitting loops along said adjacent edges of said wound knitted fabric strip; and interlocking said knitting loops on said adjacent edges of said knitted fabric strip, wherein said knitting loops are interlocked by knitting a narrow connecting section between said adjacent edges, thereby joining said knitting loops to one another.

18. An industrial fabric produced by:

knitting a fabric strip comprising monofilament or multifilament fibers, wherein a width of said knitted fabric strip is narrower than a width of said full width fabric;

spirally winding said knitted fabric strip, wherein an edge of said knitted fabric strip is adjacent to an edge of a subsequently wound knitted fabric strip;

locating knitting loops along said adjacent edges of said wound knitted fabric strip;

interlocking said knitting loops on said adjacent edges of said knitted fabric strip;

interdigitating said knitting loops along said adjacent edges of said wound knitted fabric strip; and inserting a longitudinal yarn into the interdigitated loops, thereby connecting the edges of said wound knitted fabric strip together.

* * * * *